US005656404A

United States Patent [19]

Niino et al.

[11] Patent Number: 5,656,404

[45] Date of Patent: Aug. 12, 1997

[54] LIGHT RECEIVING MEMBER WITH AN AMORPHOUS SILICON PHOTOCONDUCTIVE LAYER CONTAINING FLUORINE ATOMS IN AN AMOUNT OF 1 TO 95 ATOMIC PPM

[75] Inventors: Hiroaki Niino; Tetsuya Takei, both of Nagahama; Ryuji Okamura, Shiga-ken; Toshiyasu Shirasuna, Nagahama; Shigeru Shirai, Hikone, all of Japan

[73] Assignee: Canon Kabushiki Kaisha

[21] Appl. No.: 554,394

[22] Filed: Nov. 6, 1995

Related U.S. Application Data

[63] Continuation of Ser. No. 408,199, Mar. 21, 1995, abandoned, which is a continuation of Ser. No. 261,019, Jun. 16, 1994, abandoned, which is a continuation of Ser. No. 34,660, Mar. 22, 1993, abandoned, which is a continuation of Ser. No. 691,435, Apr. 25, 1991, abandoned.

[30] Foreign Application Priority Data

Apr. 26, 1990 [JP] Japan ..... 2-110885
Apr. 27, 1990 [JP] Japan ..... 2-112835

[51] Int. Cl.[6] ..... G03G 5/082; G03G 5/14; G03G 5/147

[52] U.S. Cl. ..... 430/57; 430/65; 430/67

[58] Field of Search ..... 430/57, 65, 67

[56] References Cited

U.S. PATENT DOCUMENTS

| | | | |
|---|---|---|---|
| 4,510,224 | 4/1985 | Yamazaki et al. | 430/57 |
| 4,539,283 | 9/1985 | Shirai et al. | 430/57 X |
| 4,624,905 | 11/1986 | Haku et al. | 430/65 |
| 4,673,629 | 6/1987 | Yamazaki et al. | 430/67 X |
| 4,795,691 | 1/1989 | Takei et al. | 430/67 |
| 4,859,554 | 8/1989 | Yamazaki et al. | 430/67 X |

*Primary Examiner*—Roland Martin
*Attorney, Agent, or Firm*—Fitzpatrick, Cella, Harper & Scinto

[57] ABSTRACT

A light receiving member having a light receiving layer comprising a photoconductive layer and a surface layer disposed on a conductive substrate, wherein the photoconductive layer comprises, from the side of the substrate, a first photoconductive layer constituted by an amorphous material containing silicon atoms as a matrix, carbon atoms, hydrogen atoms and fluorine atoms, and a second photoconductive layer constituted by an amorphous material containing silicon atoms as a matrix, and at least one kind of atoms selected from hydrogen atoms and fluorine atoms, wherein the content of said fluorine atoms in the first photoconductive layer is from 1 to 95 atomic ppm based on the content of said silicon atoms.

32 Claims, 9 Drawing Sheets

LIGHT RECEIVING MEMBER WITH AN AMORPHOUS SILICON PHOTOCONDUCTIVE LAYER CONTAINING FLUORINE ATOMS IN AN AMOUNT OF 1 TO 95 ATOMIC PPM

This application is a continuation, of application Ser. No. 08/408,199, filed Mar. 21, 1995, now abandoned; which is a continuation of application Ser. No. 08/261,019, filed Jun. 16, 1994, now abandoned; which is a continuation of application Ser. No. 08/034,660, filed Mar. 22, 1993, now abandoned; which in turn, is a continatuion of application Ser. No. 07/691,435, filed Apr. 25, 1991, now abandoned.

FIELD OF THE INVENTION

The present invention concerns a light receiving member sensitive to electromagnetic waves such as light (light in a broad meaning such as UV-rays, visible rays, infrared rays, X-rays and δ-rays). More particularly, it relates to a light receiving member having a two-layered photoconductive layer with an amorphous silicon layer containing fluorine atoms in an amount of 1 to 95 atomic ppm versus the amount of silicon atoms, which is usable especially in electrophotography.

BACKGROUND OF THE INVENTION

For photoconductive materials to constitute a light receiving layer of a light receiving member for use in an image-forming field, it is required that they have high sensitivity, high S/N ratio (photocurrent (IP)/dark current (ID)), absorption spectrum characteristics suited to electromagnetic waves to be irradiated, rapid responsivity to light and desired dark resistance, as well as they are not harmful to human bodies. In particular, for light receiving members to be employed in electrophotographic apparatus which are used as business machines at the office, it is important that they cause no public pollution during use.

From these stand points, public attention has been focused recently on photoconductive materials comprising amorphous silicon (hereinafter referred to "a-Si"), for example, as described in Offenlegungsschrifts No. 2746967 and 2855718, which disclose the use of them in electrophotographic light receiving members.

FIG. 2 is a cross sectional view schematically illustrating the layer constitution of a known electrophotographic light receiving member 200, in which are shown a conductive substrate 201 and a light receiving layer 202 comprising a-Si. The electrophotographic light receiving member is generally prepared by forming a photosensitive layer 202 comprising a-Si on a conductive substrate 201 by means of a film-forming method such as vapor deposition, sputtering, ion plating, terminal CVD, optical CVD or plasma CVD process while maintaining the conductive substrate at a temperature of 50° C. to 400° C. Among these film-forming methods for the formation of the photoconductive layer, the plasma CVD process, that is, a method of decomposing a raw material gas in glow discharge by direct current, radio frequency or microwave energy and forming an a-Si deposited layer on the conductive substrate has been put to practical use as a preferred method.

In Offenlegungsschrift No. 3046509, an electrophotographic light receiving member comprising a conductive substrate and a photoconductive layer comprising a-Si containing halogen atoms as a constituent element (hereinafter referred to as "a-Si:X") being disposed on said conductive substrate has been proposed. In this publication, it is stated that dangling bonds are compensated by incorporating 1 to 40 atomic % of halogen atoms into a-Si, to reduce the localized level density in the energy gap and obtain electrical and optical characteristics suitable as the photoconductive layer for the electrophotographic light receiving layer.

On the other hand, it has been known for amorphous silicon carbides (hereinafter referred to as "a-SiC") that they have higher heat resistance and surface hardness, and higher dark resistivity as compared with a-Si, and the optical band gap of them can be varied within a range from 0.6 to 0.8 depending on the carbon content. An electrophotographic light receiving member in which the photoconductive layer is constituted with such a-SiC is proposed in U.S. Pat. No. 4,471,042. This patent literature discloses that electrophotographic characteristics including high dark resistance and satisfactory light sensitivity are provided when the photoconductive layer of an electrophotographic light receiving member is constituted by an a-Si material containing from 0.1 to 30 atomic % of carbon as a chemical modifying substance.

Further, Japanese Patent Publication 63(1988)-35026 proposes an electrophotographic photosensitive member comprising, on a conductive substrate, an intermediate layer comprising an a-Si material containing carbon atoms, hydrogen atoms and/or fluorine atoms as the constituent elements (this a-Si material will be hereinafter referred to as "a-SiC:(H,F)") and an a-Si photoconductive layer. This electrophotographic photosensitive member is intended to reduce occurrence of crack or/and removal of the a-Si photoconductive layer without deteriorating the photoconductive characteristics by said intermediate layer comprising an a-SiC:(H,F) material.

However, for the known electrophotographic light receiving members respectively having a photoconductive layer constituted by such a-Si material, although a proper improvement has been made for each of electrical, optical and photoconductive characteristics such as dark resistance, light sensitivity, light responsivity and use-environmental characteristics, as well as aging stability and durability individually, there still exists room for further improvement in view of overall characteristics.

In recent years, high image quality, high speed processing and high durability have been further demanded for electrophotographic apparatus. Particularly, there is an increased demand for further improving electrophotographic light receiving members with respect to electric characteristics and photoconductive characteristics, as well as greatly improve the durability while maintaining high charge retentivity and high sensitivity in any of use-environments.

That is, for instance, in the case of preparing an electrophotographic light receiving member using an a-Si material, if it is intended to provide an improvement for the sensitivity and the dark resistance at the same time, there is often observed a residual voltage on the resultant electrophotographic light receiving member upon use thereof. In addition, when it is used repeatedly for a long period of time, there is a tendency that fatigue due to the repeated use is accumulated to cause a so-called "ghost" phenomenon.

Further, in the case of forming the photoconductive layer using an a-Si material, hydrogen atoms (H), halogen atoms (X) such as fluorine atoms (F) or chlorine atoms (Cl) for improving electric and photoconductive characteristics, boron atoms (B) or phosphorus atoms (P) for control of electric conduction type or other kind of atoms for improving other characteristics are incorporated respectively as the constituent atoms into the photoconductive layer. However, the resulting layer has sometimes become accompanied with defects on the electric or photoconductive characteristics or uniformity of them depending on the way of incorporating such constituent atoms. That is, the photoconductive layer has uneven portions in view of the charge transportation capacity, such uneven portions entail unevenness in the density of an image obtained, which appears particularly remarkably in a half-tone image. In view of this, there is a demand for the film constituting the photoconductive layer to be highly uniform not only in view of the matrix structure but also in view of the electrical and optical properties.

Further, as a result of improvements made recently, for instance, in optical exposure system, developing mechanism and transfer mechanism in electrophotographic apparatus in order to improve the image-forming efficiency of the electrophotographic apparatus, there is a demand for improving the electrophotographic light receiving member to be desirably suited for use in such electrophotographic apparatus. In particular, as a result of the improvement in resolution of an image, their has now been demanded a reduction in so-called "coarseness", i.e., unevenness of the image density in a minute region, and also reduction in so-called "minute blank area", i.e., image defect in the form of a minute black or white dot, in particular, reduction the minute blank area which was used to be substantially not problematic in the past. Further, in the case of forming images continuously, a phenomenon that such minute blank area appears from the initial image may sometimes occur and because of this, there is a demand for reduction in appearance of the minute blank area even after repeated use.

Further, in recent years, in order to reduce the production cost of an electrophotographic light receiving member, there has been made a proposal to form the photoconductive layer of an electrophotographic light receiving member at an increased deposition rate by a film-forming method utilizing a microwave energy, that is a so-called microwave plasma CVD method. However, in this case, there are sometimes found problems that unevenness is caused in the quality of an a-Si film deposited, or fine crack or peeling is caused for the a-Si film due to the stresses in the film, whereby the yield is decreased.

SUMMARY OF THE INVENTION

The present invention is aimed at eliminating the above-mentioned disadvantages involved in the conventional light receiving member and providing an improved light receiving member particularly suitable for use in electrophotography which meets the above-mentioned demands.

Other object of the present invention is to provide an improved light receiving member which does not cause minute blank area, coarseness and ghost on an image to be reproduced even after repeated use.

As one of the reasons of causing the minute blank area on an image in the case of the conventional light receiving member, there can be mentioned an abnormal growth (extent of spherical growth defect) of a film upon forming the photoconductive layer. Thus, a further object of the present invention is to provide an improved light receiving member having a photoconductive layer free of such extent of spherical growth defect.

A still further object of the present invention is to provide an improved light receiving member which is free of extent of spherical growth defect and which does not cause minute blank area, coarseness and ghost on an image to be reproduced even after repeated use.

The light receiving member of the present invention which attains the above objects comprises a conductive substrate and a light receiving layer disposed on said conductive substrate, said light receiving layer comprising a photoconductive layer and a surface layer being disposed in this order from the side of said conductive substrate, wherein said photoconductive layer comprises, from the side of said conductive substrate, a first photoconductive layer constituted by an amorphous material containing silicon atoms as a matrix, carbon atoms, hydrogen atoms, and fluorine atoms and a second photoconductive layer constituted by an amorphous material containing silicon atoms as a matrix, and at least one kind atoms selected from hydrogen atoms and fluorine atoms, and the content of the fluorine atoms in said first photoconductive layer is from 1 to 95 atomic ppm based on the silicon atoms.

BRIEF DESCRIPTION OF THE DRAWINGS

FIG. 4(*b*) is a lateral cross sectional view observed from above.

DETAILED DESCRIPTION OF THE INVENTION

Figure 1A:
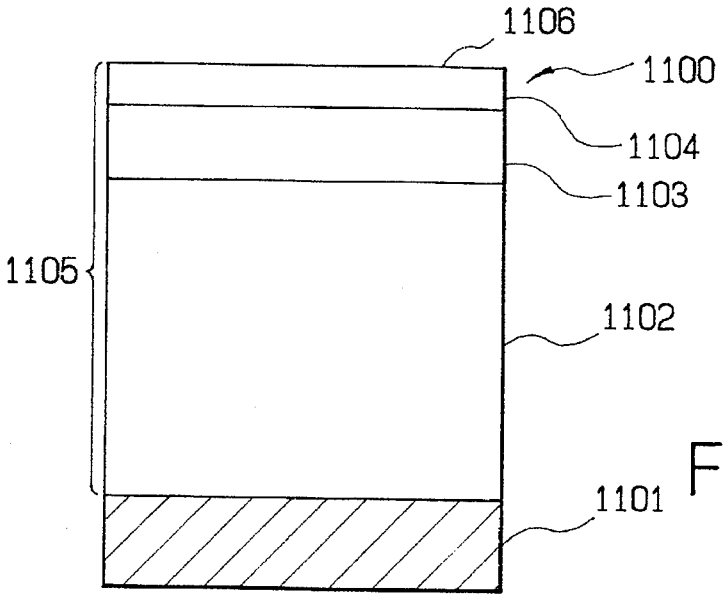
FIGS. 1(*a*) and 1(*b*) are schematic views respectively for illustrating the layer constitution of a typical embodiment of an electrophotographic light receiving member according to the present invention.

According to the present invention, since the photoconductive layer is configured to have a two-layered structure comprising a first layer constituted by an amorphous silicon carbide (hereinafter simply referred to as "non-SiC") and a second layer constituted by an amorphous silicon (hereinafter simply referred to as "non-Si") wherein said first and second layers are disposed in sequence from the side of the conductive substrate, important functions of the electrophotographic light receiving member i.e., generation of photocarriers and transportation of the generated photocarriers are shared divisionally to individual layers respectively, so that the light receiving member has a greater degree of freedom for the design of the layer and excellent characteristics than in the case where a single layer is responsible to all of such functions. Further, since the photoconductive layer is incorporated with carbon atoms, the dielectric constant of the light receiving layer can be reduced to decrease the static capacitance per layer thickness, resulting in provision of a high charge retentivity and a remarkable improvement in the photosensitivity, as well as a remarkable improvement in the high withstanding voltage to enhance the durability. In addition, since the photoconductive layer containing the carbon atoms is situated on the side of the conductive substrate, adhesion between the conductive substrate and the photoconductive layer is improved to prevent not only occurrence of film peeling and but also occurrence of minutes defects.

Further in addition, according to the present invention, since a very small amount (1 to 95 atomic ppm) fluorine atoms (F) is contained at least in the non-SiC photoconductive layer, the dangling bonds, for example, of silicon atoms (Si) and carbon atoms (C) are desirably compensated and, in particular, coagulation of carbon atoms and/or hydrogen atoms are desirably suppressed in the case where the hydrogen atoms are incorporated together with the carbon atoms. Because of this, a more stable state is attained in view of the matrix structure and internal strains of the deposited film are desirably rectified. As a result, a marked improvement is provided, in particular, for the image-forming characteristics especially with respect to appearance of coarseness, minute blank area and ghost for an image to be reproduced.

Now, in the case where the fluorine content is less than 1 atomic ppm based on the silicon atoms, there cannot be obtained an effect of making the film structure or the layer quality uniform due to the fluorine atoms. On the other hand, in the case where the fluorine content exceeds 95 atomic ppm based on the silicon atoms, the foregoing ghost phenomenon becomes liable to occur. Accordingly, it is indispensable to define the fluorine content in the range of from 1 to 95 atomic ppm based on the amount of the silicon atoms. The effect of the fluorine atoms contained in the photoconductive layer appears particularly remarkably when a layer is formed at an increased deposition rate by a microwave plasma CVD process.

Descriptions will now be made specifically for the electrophotographic light receiving member according to the present invention by way of its specific examples in conjunction with the drawings.

Figure 1B:
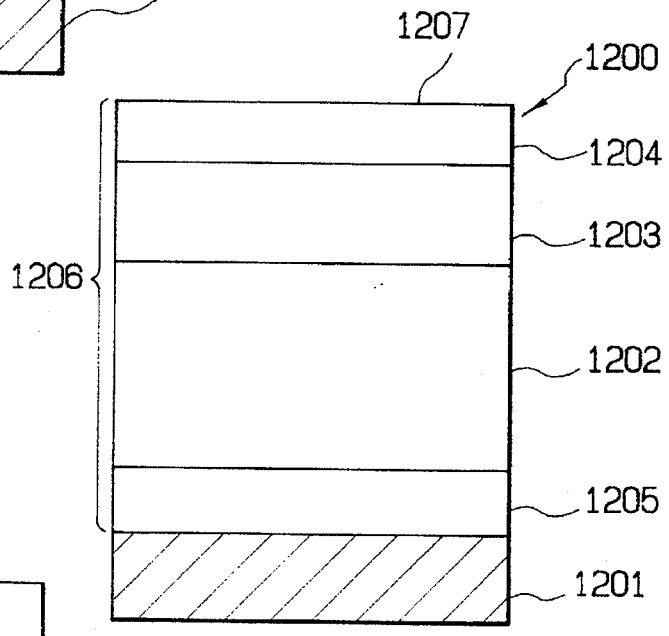
Figure 2:
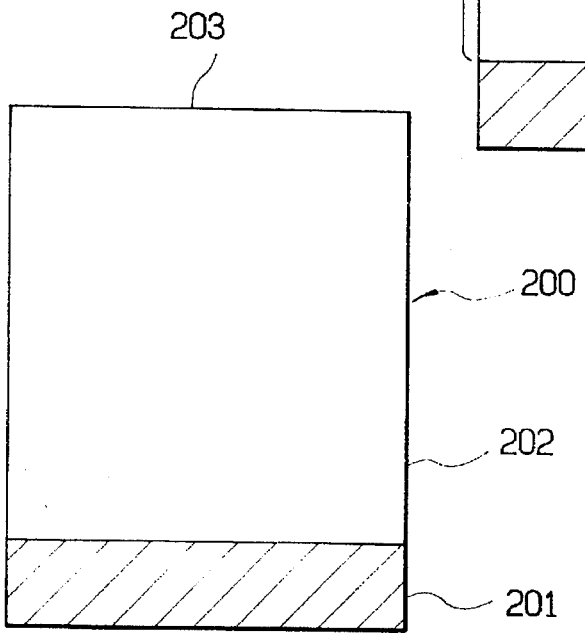
FIG. 2 is a schematic view for illustrating the layer constitution of an electrophotographic light receiving member in the prior art.

FIGS. 1(*a*) and 1(*b*) are schematic views respectively for illustrating a preferred layer constitution of an electrophotographic light receiving member according to the present invention.

An electrophotographic light receiving member 1100 shown in FIG. 1(*a*) comprises a conductive substrate 1101 to be used for an electrophotographic light receiving member and a light receiving layer 1105 disposed on the substrate 1101. The light receiving layer 1105 comprises a first photoconductive layer 1102 constituted by a non-SiC:H:F, a second photoconductive layer 1103 constituted by a non-SiC:(H,F) and a surface layer 1104 as a protective layer being disposed in this order on the conductive substrate 1101. The light receiving layer 1105 has a free surface 1106.

An electrophotographic light receiving member 1200 shown in FIG. 1(*b*) has no substantial difference, in view of the structure, from the electrophotographic light receiving member 1100 shown in FIG. 1(*a*), except that a charge injection inhibition layer 1205 is disposed between a conductive substrate 1201 and a first photoconductive layer 1202 constituted by a non-SiC:H:F. In FIG. 1(*b*), numeral reference 1206 stands for a light receiving layer, and numeral reference 1204 stands for a surface layer. The light receiving layer 1206 has a free surface 1207.

In the following, explanation will be made as for the substrate and each constituent layer in the light receiving member of the present invention.

Substrate

As the conductive substrate used in the present invention, there can be mentioned, for example, metals such as stainless steel, Al, Cr, Mo, Au, In, Nb, Te, V, Ti, Pt, Pd and Fe, as well as alloys thereof. In addition, an insulative substrate made of a film or a sheet of a synthetic resin such as polyester, polyethylene polycarbonate, cellulose acetate polyvinyl chloride, polystyrene and polyamide, glass or ceramic which has been applied with conductive treatment at least to the surface thereof on which a light receiving layer is to be formed may be also used.

The substrate may be of any configuration such as cylindrical, plate-like or belt-like shape having a smooth or uneven surface, which can be properly determined depending upon the application use. The thickness of the substrate is properly determined so that the electrophotographic light receiving member can be formed as desired. In the case where flexibility is required for the electrophotographic light receiving member, it can be made as thin as possible within a range capable of sufficiently providing the function as the substrate. However, the thickness is usually greater than 10 μm in view of fabrication, handling and mechanical strength of the substrate.

It is possible for the surface of the substrate to be uneven in order to eliminate occurrence of defective images caused by so-called interference fringe patterns being apt to appear in images formed in the case where image-formation is carried out using coherent monochromatic light such as laser beams. In this case, the uneven surface shape of the substrate can be formed by a known method as described, for example, in European Patent Laid-Open No. 155758, U.S. Pat. Nos. 4,696,884 and 4,705,733.

In an alternative, the uneven surface shape of the substrate may be composed of a plurality of fine spherical dimples which are more effective in eliminating the occurrence of defective images caused by the interference fringe patterns especially in the case of using the foregoing coherent monochromic light. In this case, the scale of each of the irregularities composed of a plurality of fine spherical dimples is smaller than the resolving power required for the electrophotographic light receiving member. The irregularities composed of a plurality of fine spherical dimples at the surface of the substrate can be formed by a known method, for example, as described in European Patent Laid-Open No. 202746.

Photoconductive Layer

The photoconductive layer of the electrophotographic light receiving member according to the present invention has a two-layered structure comprising a first photoconductive layer formed of a non-SiC:H:F:(O) material containing silicon atoms as a matrix, carbon atoms, hydrogen atoms, fluorine atoms and optionally, oxygen atoms, and a second photoconductive layer formed of a non-Si:(H,F) material silicon atoms as a matrix, and at least one kind atoms selected from hydrogen atoms and fluorine atoms, said first photoconductive layer and said second photoconductive layer being disposed in this order from the side of the substrate. The photoconductive layer thus constituted has desired photoconductive characteristics, in particular, charge possessing characteristics, charge generating characteristics and charge transporting characteristics.

As for the carbon atoms to be contained in the first photoconductive layer, they may be incorporated in a state of being distributed uniformly in the entire layer region of the first photoconductive layer. In an alternative, they may be incorporated such that the first photoconductive layer has a layer region where the carbon atoms being distributed unevenly in the thickness direction.

As for the amount of the carbon atoms to be contained in the first photoconductive layer, it is desired to be preferably in the range of from $5\times10^{-1}$ to 40 atomic %, more preferably, in the range of from 1 to 30 atomic % and, most preferably, in the range of from 1 to 20 atomic %.

By defining the amount of the carbon atoms to be contained in the first photoconductive layer in the above range, there are provided effects that a desirably increased dark resistance and a desirably high S/N ratio are obtained, and adhesion of the film is improved.

The hydrogen atoms and the fluorine atoms contained in the first photoconductive layer chiefly contribute to compensating dangling bonds of the silicon atoms. The incorporation of these atoms into the layer attains an effect of improving the layer quality, resulting in improving the photoconductive characteristics of the layer.

As for the amount of the hydrogen atoms to be contained in the first photoconductive layer, it is desired to be preferably in the range of from 1 to 40 atomic %, more preferably, in the range of from 5 to 35 atomic % and, most preferably, in the range of from 10 to 30 atomic %.

The fluorine atoms contained in the first photoconductive layer further contribute, in addition to compensating dangling bonds of the silicon atoms as above described, to preventing the carbon atoms and the hydrogen atoms from coagulating in the layer to attain an effect of improving the uniformity of the layer quality. Accordingly, the amount of the fluorine atoms to be contained in the first conductive layer is an important factor in order to make the electrophotographic light receiving member to be one that effectively attains the foregoing objects of the present invention. Thus, due regard should be had to the amount of the fluorine atoms to be contained in the first conductive layer. In a preferred embodiment, the amount of the fluorine atoms to be contained in the first conductive layer is properly determined in the range of from 1 to 95 atomic ppm based on the amount of the silicon atoms. In a more preferred embodiment, it is in the range of from 5 to 80 atomic ppm based on the amount of the silicon atoms. Further, in a most preferred embodiment, it is in the range of from 10 to 70 atomic ppm.

As above described, the second photoconductive layer may contain fluorine atoms. In this case, the amount of the fluorine atoms contained in the second photoconductive layer should made different from the amount of the fluorine atoms contained in the first photoconductive layer. The amount of the fluorine atoms contained in the second photoconductive layer is desired to be in the range of from 0.1 to 50 atomic ppm based on the amount of the silicon atoms.

As apparent from what above stated, the amount of the fluorine atoms contained in not only the first photoconductive layer but also the second photoconductive layer is a very small amount which is clearly distinguished from the amount of fluorine atoms contained in the light receiving layer of the conventional light receiving member, for example, described in Japanese Patent Publication 63(1988) -35026 wherein there is disclosed a light semiconductor device having an intermediate layer between a conductive substrate and an amorphous silicon photoconductive layer, said intermediate layer being formed of an amorphous material containing silicon and carbon atoms with a composition ratio of C/Si being 5 to 150 atomic %, hydrogen atoms in an amount of 1 to 40 atomic %, and fluorine atoms in an amount of 0.001 to 20 atomic %.

In a preferred embodiment, the first photoconductive layer is incorporated with oxygen atoms. In this case, the oxygen atoms may be incorporated in a state of being distributed uniformly in the entire layer region of the first photoconductive layer. In an alternative, they may be incorporated such that the first photoconductive layer has a layer region where the oxygen atoms being distributed unevenly in the thickness direction. The amount of the oxygen atoms to be contained in the first photoconductive layer is properly determined preferably in the range of from 600 to 10,000 atomic ppm, or more preferably, in the range of from 600 to 5,000 atomic ppm respectively based on the amount of the silicon atoms.

In the electrophotographic light receiving member of the present invention, the composition of the second photoconductive layer is different from that of the first photoconductive layer as above described and because of this, the second photoconductive layer exhibits excellent charge generation characteristics upon receiving light irradiation.

In general, the second photoconductive layer substantially contains none of carbon atoms, oxygen atoms and nitrogen atoms. However, it may contain at least one kind of atoms selected from the group consisting of carbon atoms, oxygen atoms and nitrogen atoms in a total amount of $5\times10^{-2}$ atomic % or less. In this case, further improvements are provided with respect to the dark resistance, film adhesion and sensitivity.

In particular, it has been confirmed by experiments that the photoconductive characteristics, image-forming characteristics and durability of the electrophotographic light receiving member of the present invention are remarkably improved when the first photoconductive layer is by a non-SiC:H:F:O in which at least each of the carbon atoms, fluorine atoms and oxygen atoms are contained in an amount within the foregoing respective defined ranges.

In the present invention, the first and the second photoconductive layers can be properly formed by a vapor deposition film-forming process while setting the conditions for the numerical values of film-forming parameters properly so as to obtain desired characteristics. Specifically, the photoconductive layer can be formed by various ways of thin film deposition processes, for example, glow-discharge process (alternating current discharge CVD process such as low frequency CVD, radio frequency CVD or microwave CVD, or direct current discharge CVD process), sputtering process, vapor deposition process, ion plating process, optical CVD process and thermal CVD process. Such thin film deposition processes can be properly selected and adopted depending on factors such as production conditions, installation cost, production scale and characteristics desired for the electrophotographic light receiving materials to be prepared. Glow discharge process, sputtering process or ion plating process is suitable since conditions for producing an electrophotographic light receiving member having desired characteristics can be controlled relatively easily. The layer may be formed by using these methods in combination in one identical system. For instance, a non-SiC:H:F:O photoconductive layer may be formed by a glow discharge process, basically, by introducing a raw material gas for supplying Si capable of supplying silicon atoms (Si), a raw material gas for supplying C capable of supplying carbon atoms (C), a raw material gas for supplying H capable of supplying hydrogen atoms (H), a raw material gas for supplying F capable of supplying fluorine atoms (F) and a raw material gas for supplying O capable of supplying oxygen atoms (O), in a desired gaseous state into a reaction vessel the inner pressure of which being capable of being reduced, causing glow discharge in the reaction vessel and forming a layer comprising a non-SiC:H:F:O on the surface of a predetermined substrate previously disposed at a predetermined position.

As the raw material that can be used effectively as the Si supplying gas in the present invention, there can be mentioned gaseous or gasifiable silicon hydrides (silanes) such as $SiH_4$, $Si_2H_6$, $Si_3H_8$ and $Si_4H_{10}$. Among these, $SiH_4$ and $Si_2H_6$ are most preferred in view of easy handling upon forming the layer and high Si supplying efficiency. The raw material gas supplying Si may be diluted, if required, with a gas such as $H_2$, He, Ar or Ne.

The raw material for introducing carbon atoms usable in the present invention is preferably a material which is gaseous at a normal temperature and a normal pressure or a material which can be easily gasified at least under layer-forming conditions.

As the starting material that can be used effectively as the raw material gas for introducing the carbon atoms (C), there can be mentioned those comprising C and H as constituent atoms, for example, saturated hydrocarbons with 1 to 5 carbon atoms, ethylenic hydrocarbons with 2 to 4 carbon atoms and acetylenic hydrocarbons with 2 to 3 carbon atoms.

More specifically, there can be mentioned methane ($CH_4$), ethane ($C_2H_6$), propane ($C_3H_8$), n-butane (N—$C_4H_{10}$) and pentane ($C_5H_{12}$) as the saturated hydrocarbons; ethylene ($C_2H_4$), propylene ($C_3H_6$), butene-1 ($C_4H_8$), butene-2 ($C_4H_8$), isobutylene ($C_4H_8$) and pentene ($C_5H_{10}$) as the ethylenic hydrocarbons and acetylene ($C_2H_2$), methylacetylene ($C_3H_4$) and butine ($C_4H_6$) as the acetylenic hydrocarbons.

Further, as the starting material gas comprising Si and C as the constituent atoms, there can be mentioned, for example, alkyl silicides such as $Si(CH_3)_4$ and $Si(C_2H_5)_4$.

In addition, fluorinated hydrocarbons such as $CF_4$, $CF_3$, $C_2F_6$, $C_3F_8$ and $C_4F_8$ can also be mentioned since fluorine atoms can also be introduced in addition to the introduction of the carbon atoms (C).

As the starting material that can be used effectively as the gas for introducing the oxygen atoms (O) in the present invention, there can be mentioned, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), trinitrogen tetraoxide ($N_3O_4$) and dinitrogen pentaoxide ($N_2O_5$).

In addition, compounds such as CO and $CO_2$ may also be mentioned since the oxygen atoms can also be introduced in addition to the introduction of the carbon atoms (C).

As the fluorine-supplying gases that can be used effectively in the present invention, there can be mentioned, preferably, for example, gaseous or gasifiable fluoro compounds such as fluorine gas, fluoride, fluoro-containing inter-halogen compound and fluoro-substituted silane derivative. Further, gaseous or gasifiable fluro-containing silicon hydride compound containing silicon atoms and fluorine atoms as the constituent elements can also be mentioned as effective compounds.

As the fluoro compound suitably usable in the present invention, there can be mentioned, for example, fluorine gas ($F_2$), and inter-halogen compounds such as BrF, ClF, $ClF_3$, $BrF_3$, $BrF_5$, $IF_3$, $IF_7$.

As the fluoro-containing silicon compounds, so-called fluoro-substituted silane derivatives, there can be mentioned, specifically, for example, silicon fluorides such as $SiF_4$ and $Si_2F_6$. In the case of forming a distinctive electrophotographic light receiving member of the present invention by a glow discharge process or the like by using the fluoro-containing silicon compound as described above, a photoconductive layer comprising a non-Si:H:F can be formed without using any silicon hydride gas as a gas for supplying Si. However, for controlling the introduction ratio of the hydrogen atoms into the photoconductive layer to be formed more easily, it is preferred to form the layer by admixing hydrogen gas or a hydrogen-containing silicon compound gas in a desired amount to the above-mentioned gas. Further, each of the gases described above may be used alone or a plurality of them may be mixed at a predetermined mixing ratio.

In the present invention, the fluorides or the fluoro-containing silicon compounds described above are used effectively as the fluorine atom-supplying gas, but other than these, other gaseous or gasifiable materials such as HF and fluoro-substituted silicon hydrides e.g. $SiH_3F$, $SiH_2F_2$ and $SiHF_3$ can also be mentioned as the effective raw material for forming the photoconductive layer. In this case, the hydrogen-containing fluorides are desirably used as the suitable fluorine atom supplying gases, since hydrogen atoms which are extremely effective for the control of the electrical or photoelectric characteristics can also be introduced simultaneously with the introduction of the fluorine atoms in the layer upon forming the photoconductive layer.

In order to structurally introduce hydrogen atoms into the photoconductive layer, it is possible to cause glow discharge in the presence of $H_2$ or a silicon hydride such as $SiH_4$, $Si_2H_6$, $Si_3H_8$ and $Si_4H_{10}$ and silicon or a silicon compound for supplying Si in a reaction vessel.

The amount of the hydrogen atoms and/or the amount of the fluorine atoms to be incorporated into the photoconductive layer can be desirably adjusted, for example, by controlling the temperature of the substrate, the amount of the raw material capable of supplying hydrogen atoms or fluorine atoms to be introduced into the reaction vessel and the discharging electric power to be applied.

Further, in the present invention, atoms (M) of an element capable of controlling the conductivity (hereinafter referred to as "conductivity controlling atoms" or "conductivity controlling element") are preferably incorporated as required, into the photoconductive layer.

The conductivity controlling atoms (M) may be incorporated in a state of being distributed uniformly in the entire layer region of the photoconductive layer. In an alternative, they may be incorporated such that the photoconductive layer has a layer region where the conductivity controlling atoms being distributed unevenly in the thickness direction.

As the conductivity controlling element, so-called impurities in the field of the semiconductor can be mentioned and those usable herein are elements belonging to the group III of the periodic table that provide p-type conductivity (hereinafter simply referred to as "group III element") or elements belonging to the group V of the periodic table that provide n-type conductivity (hereinafter simply referred to as "group V element").

Specifically, the group III element can include B (boron), Al (aluminum), Ga (gallium), In (indium) and Tl (thallium), and among these, B, Al and Ga being particularly preferred. The group V element can include, for example, P (phosphorus), As (arsenic), Sb (antimony) and Bi (bismuth), and among these, P and Sb being particularly preferred.

As for the amount of the conductivity controlling atoms (M) to be contained in the photoconductive layer, it is desired to be preferably in the range of from $1\times10^{-3}$ to $5\times10^{-4}$ atomic ppm, more preferably, in the range of from $1\times10^{-2}$ to $1\times10^{4}$ atomic ppm and most preferably, in the range of from $1\times10^{-1}$ to $5\times10^{3}$ atomic ppm respectively based on the amount of the silicon atoms.

In the case where the content of the carbon atoms (C) in the photoconductive layer is less than $1\times10^{3}$ atomic ppm, the amount of the atoms (M) to be incorporated into the photoconductive layer is desired to be preferably in the range of from $1\times10^{-3}$ to $1\times10^{3}$ atomic ppm. In the case where the content of the carbon atoms (C) is greater than $1\times10^{3}$ atomic ppm, the amount of the atoms (M) to be incorporated into the photoconductive layer is desired to be preferably in the range of from $1\times10^{-1}$ to $5\times10^{-4}$ atomic ppm.

In order to structurally introduce the conductivity controlling atoms of the group III element or the group V element into the photoconductive layer, a gaseous raw material capable of supplying such atoms is introduced into the reaction vessel together with other gases for forming the photoconductive layer upon forming the layer.

As the raw material capable of supplying the group III atoms and as the raw material capable of supplying the group V atoms, it is desired to adopt those which are gaseous at a normal temperature and a normal pressure or those which can be easily gasified at least under the layer-forming conditions. Specifically, the raw material capable of supplying the group III atoms can include, for example, boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$, $BBr_3$ which can supply boron atoms. Other than these, there can be also mentioned $AlCl_3$, $GaCl_3$, $Ga(CH_3)_3$, $InCl_3$ and $TlCl_3$.

As the raw materials usable effectively for introducing the group V atoms, there can be mentioned phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$ and $PI_3$ for introducing phosphorus atoms. In addition, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$ can also be mentioned as raw materials for effectively introducing the group V atoms.

Further, these raw materials for introducing the atoms (M) may be diluted with a gas such as $H_2$, He, Ar or Ne upon use, if necessary.

Further, the photoconductive layer in the light receiving member according to the present invention may also contain atoms (M') of at least an element selected from the group consisting of group Ia, IIa, IVa and VIII elements of the periodic table. The atoms (M') may be incorporated in a state of being distributed uniformly in the entire layer region of the photoconductive layer. In an alternative, they may be incorporated such that the photoconductive layer has a layer region where the atoms (M') being distributed unevenly in the thickness direction.

However, in any of the cases, it is necessary for the atoms (M') to be throughout distributed with a uniform state in the plane direction in parallel with the surface of the substrate in view of attaining uniformity of the characteristics in the plane direction.

As the group Ia element, there can be mentioned, specifically, Li (lithium), Na (sodium) and K (potassium). Likewise, as the group IIa element, there can be mentioned Be (beryllium), Mg (magnesium), Ca (calcium), Sr(strontium) and Ba (barium).

Further, as the group VIa element, there can be mentioned, specifically, Cr (chromium), Mo (molybdenum) and W (tungsten). As the group VIII element, there can be mentioned, Fe (iron), Co (cobalt) and Ni (nickel).

As for the thickness of the photoconductive layer, it should be properly determined having due regards not only on the electrophotographic characteristics desired for the resulting electrophotographic light receiving member and but also on economical effects.

Particularly, as for the thickness of the first conductive layer, it should be determined having due regards so that the first conductive layer exhibits a sufficient charge possessing performance and desirably functions to prevent occurrence of ghosts on an image obtained. In view of this, the first conductive layer is made to be of a thickness preferably in the range of from 10 to 40 μm, more preferably, in the range of from 20 to 30 μm and most preferably, in the range of from 15 to 25 μm.

The thickness of the second photoconductive layer should be determined having due regard so that the second photoconductive layer desirably functions to generate photocarriers depending on the intensity of light irradiated and also having due regards on the interrelation with the thickness of the first photoconductive layer. In view of this, the second photoconductive layer is made to be a thickness preferably in the range of from 0.01 to 30 μm, more preferably in the range of from 0.1 to 20 μm and most preferably, in the range of from 1 to 10 μm.

For forming a photoconductive layer comprising a non-Si:H:F material or a photoconductive layer comprising a non-SiC:H:F:O material respectively having characteristics capable of attaining the object according to the present invention, it is necessary that the temperature of the substrate and the gas pressure in the reaction vessel upon layer formation are properly adjusted depending on the requirements.

As for the temperature of the substrate (Ts) upon layer formation, it is properly selected within an optimum range in accordance with the design for the layer. In general, it is preferably from 100° to 450° C. and more preferably, from 200° to 400° C.

The gas pressure in the reaction vessel upon layer formation is also properly selected within an optimum range in accordance with the design for the layer. In general, it is preferably from $1\times10^{-4}$ to 10 Torr, more preferably, from $5\times10^{-4}$ to 3 Torr and most preferably, from $1\times10^{-3}$ to 1 Torr.

However, the actual conditions for forming each of the first and second photoconductive layers such as the temperature of the substrate, the gas pressure in the reaction vessel and the discharging power cannot usually be determined with ease independent of each other. Accordingly, the conditions optimal to the layer formation are desirably determined based on relative and organic relationships for forming each of the first and second photoconductive layers respectively having desired properties.

In the light receiving member according to the present invention, a layer region in which a composition varies continuously may be disposed between the first photoconductive layer and the second conductive layer and/or between the second photoconductive layer and the surface layer. The disposition of such layer region can further improve the injection property of the photocarriers between each of the layers and improve the adhesion between each of the layers.

Further, in the light receiving member according to the present invention, it is desired that a layer region containing at least aluminum atoms, silicon atoms, carbon atoms and hydrogen atoms in a state of being distributed unevenly in the thickness direction is disposed in the region of the first photoconductive layer which is situated on the side of the substrate.

Surface Layer

The surface layer in the present invention is desirably constituted by a non-Si (C, O, N):(H, X) material containing silicon atoms, at least one kind of atoms selected from the group consisting of carbon atoms, nitrogen atoms and oxygen atoms, and at least one kind of atoms selected from the group consisting of hydrogen atoms and halogen atoms as the constituent elements. The surface layer does not contain at all or does substantially not contain the foregoing conductivity controlling atoms (M) which are optionally contained in the photoconductive layer.

As above described, the surface layer contains at least one kind of atoms selected from the group consisting of carbon atoms, nitrogen atoms and oxygen atoms (hereinafter referred to as "atoms (C,N,O)"). The atoms (C,N,O) may be incorporated in a state of being distributed in the entire layer region of the surface layer. In an alternative, the atoms (C,N,O) may be incorporated such that the surface layer has a layer region where the atoms (C,N,O) being distributed unevenly in the thickness direction. However, in any case, it is necessary for the atoms (C,N,O) to be throughout distributed with a uniform state in the plane direction in parallel with the surface of the substrate in view of attaining uniformity of the characteristics in the plane direction.

The atoms (C,N,O) contained in the entire region of the surface layer chiefly contribute to improving the dark resistance and the hardness. The amount of the atoms (C,N,O) to be contained in the surface layer is, preferably, from $1\times10^{-3}$ to 90 atomic %, more preferably, from $1\times10^{-1}$ to 85 atomic % and most preferably, from 10 to 80 atomic % in terms of a total amount.

Further, as above described, the surface layer contains at least one kind of atoms selected from the group consisting of hydrogen atoms and halogen atoms (hereinafter referred to as "atoms (H,X)"). The atoms (H,X) contained in the surface layer contributes to desirably compensating dangling bonds present in the non-Si (C, N, O):(H, X) material, whereby improving the film quality. The amount of the hydrogen atoms, the amount of the halogen atoms or the sum of the amounts for the hydrogen atoms and the halogen atoms to be contained in the surface layer is, preferably, from 1 to 70 atomic %, more preferably, from 5 to 50 atomic % and most preferably, from 10 to 30 atomic %.

As for the thickness of the surface layer, it should be properly determined having due regards only on the electrophotographic characteristics desired for the resulting electrophotographic light receiving member, on the interrelation with the photoconductive layer and also on economical effects. In view of this, the surface layer is made to be of a thickness preferably in the range of from 0.003 to 30 μm, more preferably in the range of from 0.01 to 20 μm and most preferably, in the range of from 0.1 to 10 μm.

The surface layer constituted by the foregoing non-Si (C, N, O):(H, X) material can be formed in the same manner as in the case of forming the photoconductive layer.

The temperature of the substrate and the gas pressure in a reaction vessel are important factors in order to form the foregoing surface layer which exhibits the characteristics required therefor. As for the temperature of the substrate upon layer formation, it is properly selected within an optimum range and it is, preferably, from 20° to 500° C., more preferably, from 50° to 480° C. and most preferably, from 100° to 450° C.

The gas pressure in the reaction vessel is also selected properly from an optimum range and it is, preferably, from $1\times10^{-5}$ to 10 Torr, more preferably, from $5\times10^{-5}$ to 3 Torr and most preferably, from $1\times10^{-4}$ to 1 Torr.

However, the actual conditions for forming the surface layer such as the temperature of the substrate, the gas pressure in the reaction vessel and the discharging power cannot usually be determined with ease independent of each other. Accordingly, the conditions optimal to the layer formation are desirably determined based on relative and organic relationships for forming the surface layer having desired properties.

Charge Injection Inhibition Layer

In the electrophotographic light receiving member of the present invention, it is preferred to further comprise a charge injection inhibition layer composed of a non-Si material having a function of preventing injection of charges from the conductive substrate into the photoconductive layer which is disposed between the conductive substrate and the photoconductive layer. The charge injection inhibition layer has a so-called polarity dependency such that it provides a function of preventing injection of charges from the conductive substrate into the photoconductive layer when the light receiving layer undergoes charging treatment of a certain polarity to the free surface thereof, whereas it does not provide such a function when the layer undergoes charging treatment of an opposite polarity. In order for the charge injection inhibition layer to exhibit these functions, a relatively large amount of atoms (M") of a conductivity controlling element capable of providing a given conduction type is contained in the charge injection inhibition layer.

The atoms (M") may be incorporated in a state of being distributed in the entire layer region of the charge injection inhibition layer. In an alternative, the atoms (M") may be incorporated such that the charge injection inhibition layer has a layer region where the atoms (M") being distributed unevenly in the thickness direction. In the case where the concentration distribution of the atoms (M") is uneven, it is desired that the atoms (M") are distributed with a relatively high concentration in the region situated on the side of the substrate. However, in any case, it is necessary for the atoms (M") to be throughout distributed with a uniform state in the plane direction in parallel with the surface of the substrate in view of attaining uniformity of the characteristics in the plane direction.

As the foregoing conductivity controlling element for the atoms (M"), so-called impurities in the field of the semiconductor can be mentioned and those usable herein are elements belonging to the group III of the periodic table that provide a p-type conductivity ("group III element") or elements belonging to the group V of the periodic table that provide an n-type conductivity ("group V element").

Specifically, the group III element can include B (boron), Al (aluminum), Ga (gallium), In (indium) and Tl (thallium), and among these, B, Al, Ga being particularly preferred. The group V element can include, for example, P (phosphorus), As (arsenic), Sb (antimony) and Bi (bismuth), and among these, P and Sb being particularly preferred.

The amount of the atoms (M") to be contained in the charge injection inhibition layer should be properly determined in accordance with the requirement so as to effectively attain the object of the present invention. It is, preferably, from 30 to $5\times10^4$ atomic ppm, more preferably, from 50 to $1\times10^4$ atomic ppm and most preferably, from $1\times10^2$ to $5\times10^3$ atomic ppm.

Further, by incorporating at least one kind of atoms selected from the group consisting of carbon atoms, nitrogen atoms and oxygen atoms (hereinafter referred to as "atoms (C,N,O)") in the charge injection inhibition layer, it is possible to further improve the adhesion between the charge injection inhibition layer and other layer disposed in direct contact therewith.

The atoms (C,N,O) may be incorporated in a state of being distributed in the entire layer region of the charge injection inhibition layer. In an alternative, the atoms (C,N,O) may be incorporated such that the charge injection inhibition layer has a layer region where the atoms (C,N,O) being distributed unevenly in the thickness direction. However, in any case, it is necessary for the atoms (C,N,O) to be throughout distributed with a uniform state in the plane direction in parallel with the surface of the substrate in view of attaining uniformity of the characteristics in the plane direction.

The amount of the atoms (C,N,O) to be contained in the entire region of the charge injection inhibition layer should be properly determined such that the object of the present invention can be attained effectively. However, in general, the amount of the atoms (C,N,O) to be contained in the charge injection inhibition layer is, preferably, from $1\times10^{-3}$ to 90 atomic %, more preferably, from $5\times10^{-3}$ to 80 atomic % and, most preferably, from $1\times10^{-2}$ to 50 atomic % respectively in terms of a total amount.

The charge injection inhibition layer may contain at least one kind of atoms selected from the group consisting of hydrogen atoms and halogen atoms (hereinafter referred to as "atoms (H,X)"). The atoms (H,X) contained in the charge injection inhibition layer provides an effect of compensating dangling bonds present in the layer to improve the layer quality. The amount of the atoms (H,X) to be contained in the charge injection inhibition layer is, preferably, from 1 to 70 atomic %, more preferably, from 5 to 50 atomic % and most preferably, from 10 to 30 atomic % respectively in terms of a total amount.

The charge injection inhibition layer is desired to be of a thickness preferably, in the range of from 0.01 to 10 μm, more preferably, in the range of from 0.05 to 7 μm and most preferably, in the range of from 0.1 to 5 μm in order to obtain, for example, desired electrophotographic characteristics and economical effects.

The charge injection inhibition layer can be formed in the same manner as in the case of forming the photoconductive layer.

The temperature of the substrate and the gas pressure in a reaction vessel are important factors in order to form the charge injection inhibition layer which exhibits the characteristics required therefor. As for the temperature of the substrate upon layer formation, it is properly selected within an optimum range and it is, preferably, from 20° to 500° C., more preferably, from 50° to 480° C. and most preferably, from 100° to 450° C.

The gas pressure in the reaction vessel is also selected properly from an optimum range and it is, preferably, from $1\times10^{-5}$ to 10 Torr, more preferably, from $5\times10^{-5}$ to 3 Torr and most preferably, from $1\times10^{-4}$ to 1 Torr.

However, the actual conditions for forming the charge injection inhibition layer such as the temperature of the substrate, the gas pressure in the reaction vessel and the discharging power cannot usually be determined with ease independent of each other. Accordingly, the conditions optimal to the layer formation are desirably determined based on relative and organic relationships for forming the charge injection inhibition layer having desired properties.

Description will now be made specifically to an apparatus and a method of forming deposited films by using a high frequency wave plasma CVD process and a microwave plasma CVD process.

Figure 3:
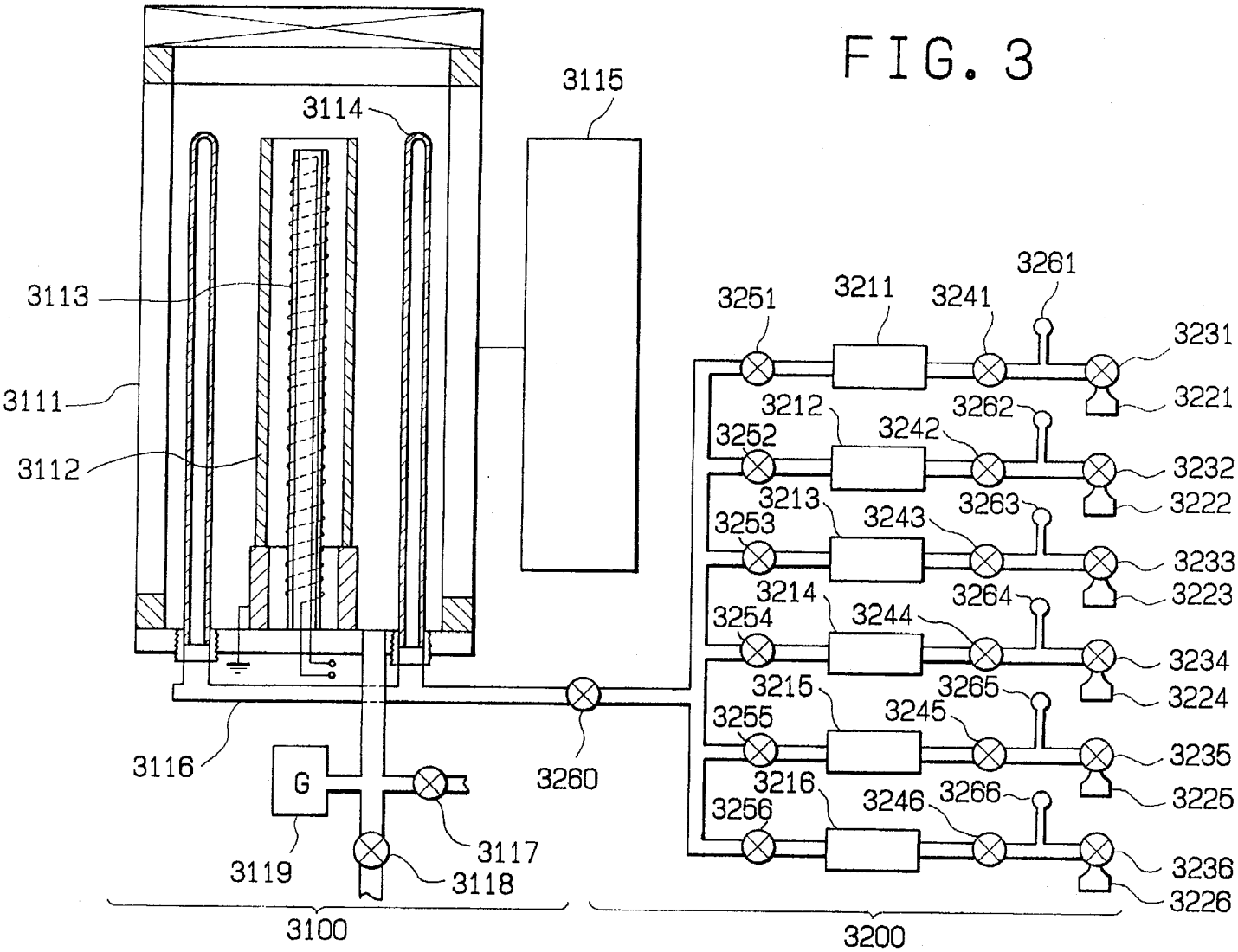
FIG. 3 is a schematic explanatory view of a fabrication apparatus by a glow-discharge process using radio frequency (RF), as an example of an apparatus for forming the light receiving layer of the electrophotographic light receiving member according to the present invention.
Figure 4A:
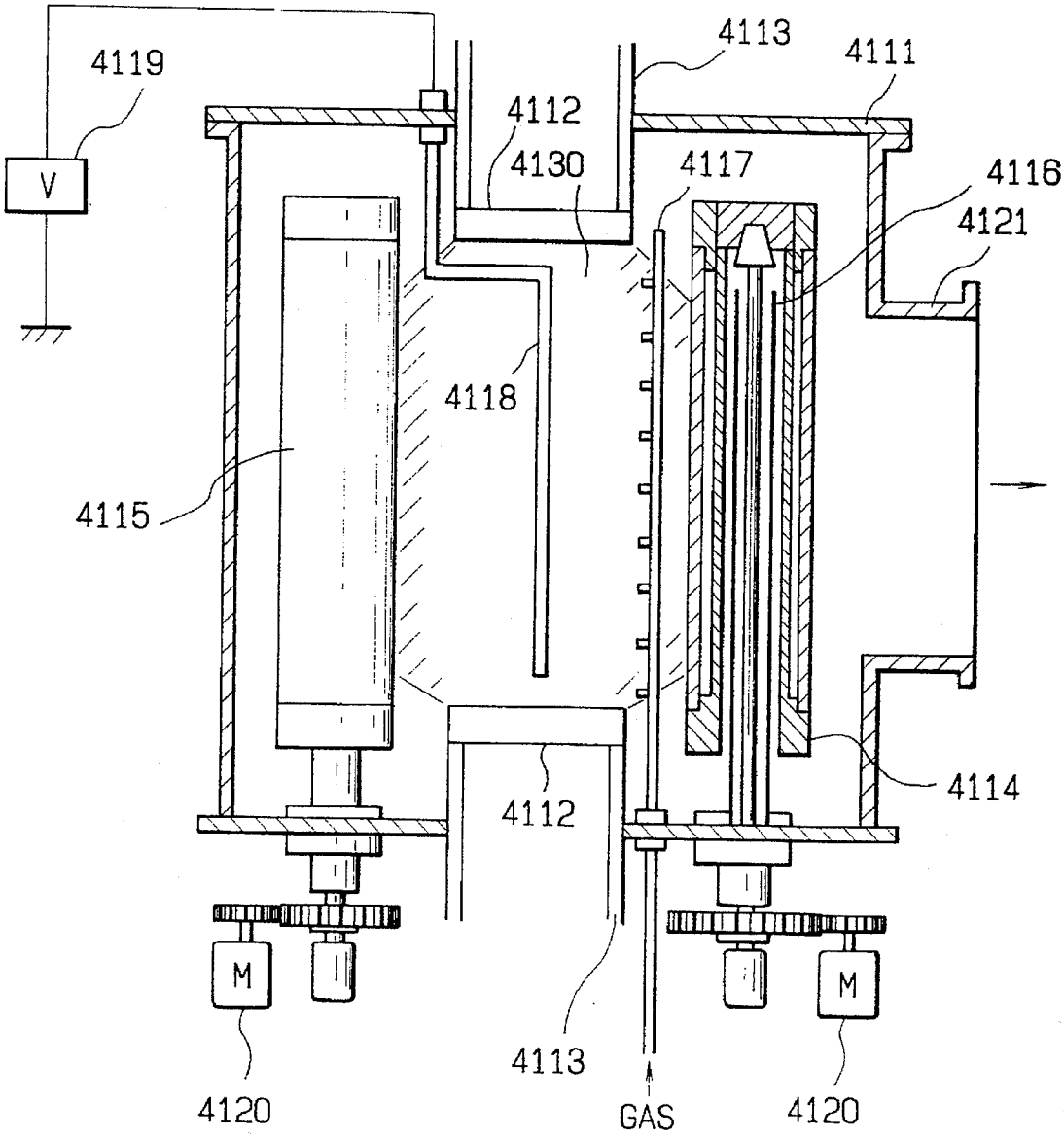
FIGS. 4(*a*), 4(*b*) and FIG. 5 are schematic explanatory views respectively of a fabrication apparatus for an electrophotographic light receiving member by a glow discharge process using a microwave energy, as an example of an apparatus for forming the light receiving layer of the electrophotographic light receiving member according to the present invention, in which FIG. 4(*a*) is a side elevational cross sectional view for a deposited layer forming device.
Figure 4B:
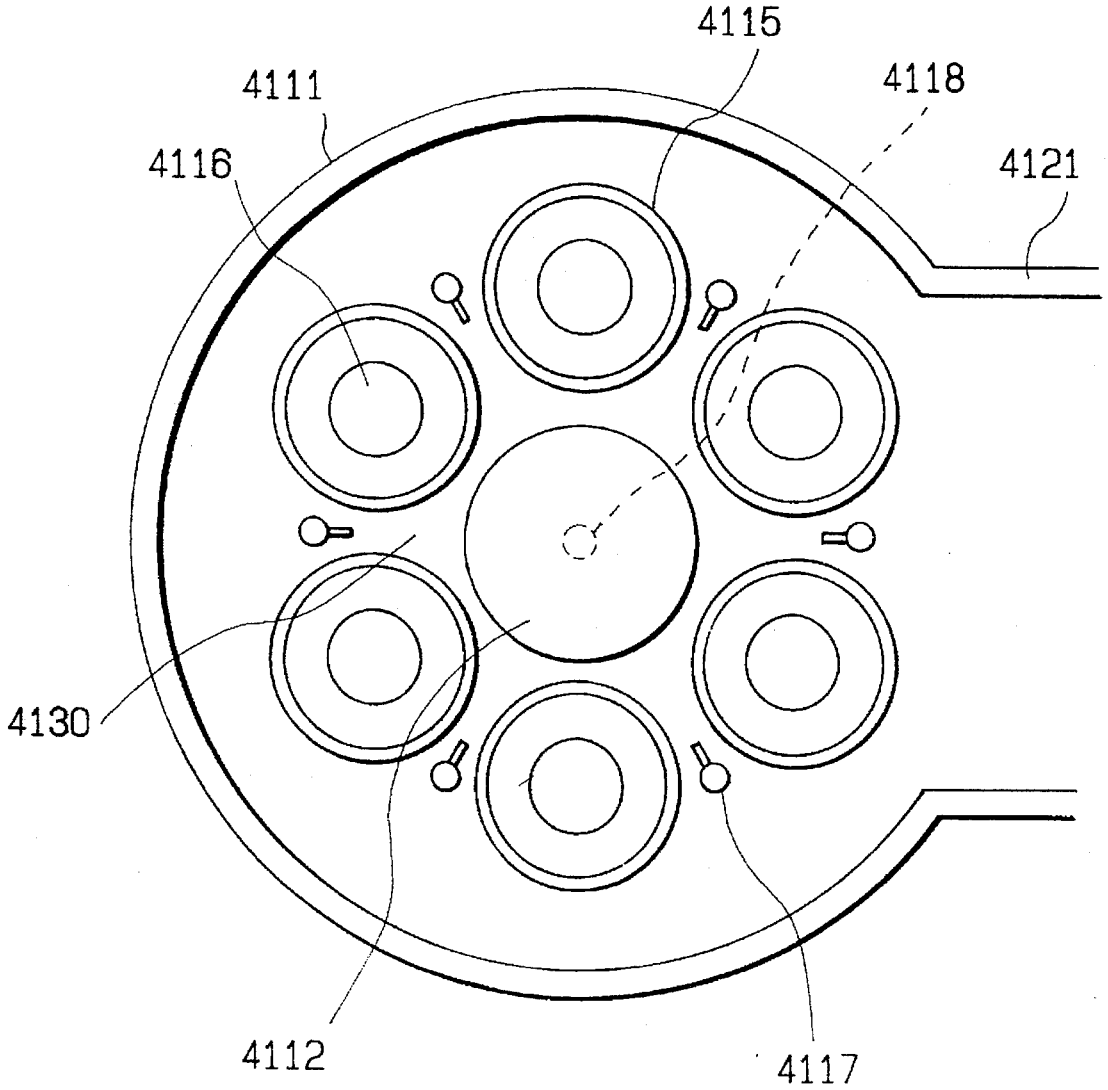
Figure 5:
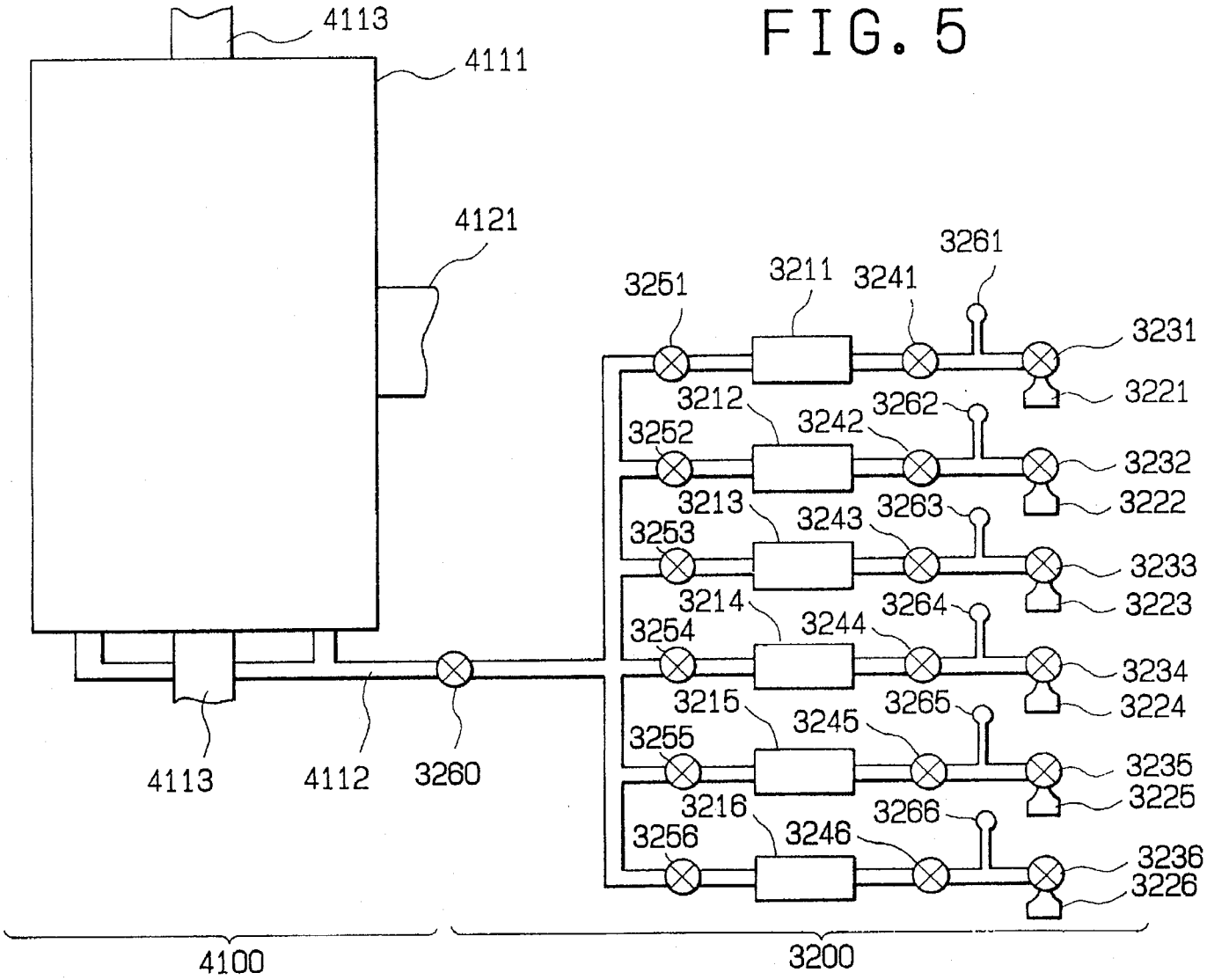
FIG. 5 shows a raw material supply device.

FIG. 3 is a schematic view for illustrating one example of an apparatus for producing an electrophotographic light receiving member by using a high frequency wave plasma CVD process (hereinafter referred to as "RF-PCVD"), and FIG. 4 is a schematic view for illustrating one example of a deposited film forming apparatus that forms deposited films for producing an electronic photographic light receiving member by a microwave plasma CVD process (hereinafter referred to as "μW-PCVD") and FIG. 5 is an explanatory view of an apparatus for producing the electrophotographic light receiving member by the μW-PCVD process.

The production apparatus for the deposited film according to the RF-PCVD process shown in FIG. 3 has the following constitution. The apparatus generally comprises a deposition device 3100, a raw material gas supply device 3200 and an evacuation device (not illustrated) for reducing the pressure inside the reaction chamber 3111. A cylindrical substrate 3112, a substrate heating heater 3113 and a raw material gas introduction pipe 3114 are disposed at the inside of the reaction chamber 3111 in the deposition device 3100 and, further, an RF matching box 3115 is connected.

The raw material gas supply device 3200 comprises reservoirs 3221–3226 for material gases such as $SiH_4$, $GeH_4$, $H_2$, $CH_4$, $B_2H_6$ and $PH_3$, valves 3231, - - - 3236, 3241, - - - 3246, 3251 - - - 3256 and mass flow controllers 3211–3216, in which the reservoir for each of the raw material gases is connected by way of a valve 3260 to the gas introduction pipe 3114 in the reaction chamber 3111.

The deposited films can be formed by using the apparatus, for example, as described below.

At first, the cylindrical substrate 3112 is disposed in the reaction chamber 3111 and the inside of the reaction chamber 3111 is evacuated by a not-illustrated evacuation device (for example, vacuum pump). Subsequently, the temperature for the cylindrical substrate 3112 is controlled to a predetermined temperature from 20° C. to 500° C. by the substrate heating heater 3113.

For introducing the raw material gas for forming the deposited films into the reaction chamber 3111, closure of the gas reservoir valves 3231–3236 and the leak valve 3117 of the reaction chamber, as well as opening of the inflow valves 3241–3246, exit valves 3251–3256 and the auxiliary valve 3260 are confirmed and then the main valve 3118 is opened to evacuate the inside of the reaction chamber 3111 and the gas pipeline 3116.

Then, when the reading on the vacuum gauge 3119 reaches about $5\times10^{-6}$ Torr, the auxiliary valve 3260 and the exit valves 3251–3256 are closed. Subsequently, each of the gases in the gas reservoirs 3221–3226 is introduced by opening each of the valves 3231–3236 and the pressure for each of the gases is controlled to 2 kg/cm$^2$ by pressure controllers 3261–3266. Then, the inflow valves 3241–3246 are gradually opened to introduce the gases into the mass flow controllers 3211–3216 respectively.

After the preparation for the film formation has thus been completed, each of the layers, that is, the charge injection inhibition layer, the photoconductive layer and the surface layer is formed on the cylindrical substrate 3112. When the temperature for the cylindrical substrate 3112 reaches a predetermined level, the relevant exit valves 3251–3256 and the auxiliary valve 3260 are gradually opened and predetermined gases are introduced from the gas reservoirs 3221–3226 by way of the gas introduction pipe 3114 into the reaction chamber 3111. Then, each of the raw material gases is controlled to a predetermined flow rate by each of the mass controllers 3211–3216. In this case, the opening degree for the main valve 3118 is controlled such that the pressure at the inside of the reaction chamber 3111 is set to a predetermined pressure less than 1 Torr while observing the reading on the vacuum gauge 3119. When the pressure is stabilized, an RF power source (not illustrated) is set to a desired power and RF power is introduced through the RF matching box 3115 into the reaction chamber 3111 to initiate RF glow discharge. The raw material gases introduced into the reaction chamber are decomposed by the electric discharge energy and predetermined deposited films mainly composed of silicon are formed on the cylindrical substrate 3112. After the formation of the film with a desired thickness, supply of the RF power is interrupted and the exit valves are closed to interrupt the introduction of the gases in the reaction chamber to complete the formation of the deposited films.

By repeating the similar procedures for several times, a desired light receiving layer having a multi-layered structure is formed.

It will be apparent that all of other exit valves than those for the required gases are closed upon forming the respective layers. Further, in order to avoid the respective gases from remaining in the reaction chamber 3111 and in the pipelines from the exit valves 3251–3256 to the reaction chamber 3111, a procedure of once evacuating the inside of the system to a high vacuum by closing the exit valves 3251–3256, opening the auxiliary valve 3260 and fully opening the main valve 3118 is conducted as required.

Further, for uniformly forming the films, the cylindrical substrate 3112 is revolved at a predetermined velocity by a driving device (not illustrated) during formation of the films.

It will be apparent that the kind of the gases and the operations for the valves are properly changed in accordance with the conditions for forming the respective layers.

Any temperature may be effective for the substrate upon forming the deposited films, and it is desirable that the temperature is from 20° C. to 500° C., preferably, from 50° C. to 480° C. and, more preferably, from 100° C. to 450° C. for attaining satisfactory effect.

The heating for the substrate may be applied by using any of heat generating members specified so as to be operated under vacuum. More specifically, there can be mentioned electric resistance heat generating member such as sheath heater, wire-wound heater, plate heater or ceramic heater, heat radiation lamp neat generating member such as halogen lamp and infrared lamp, and heat generating member having heat exchanging means using liquid, gas or the like as a heat medium. As the material for constituting the surface of the heating means, there can be used metals such as stainless steel, nickel, aluminum or copper, as well as ceramics and heat resistant polymeric resins.

Further, a method of disposing a chamber exclusively used for heating in addition to the reaction chamber, heating the substrate and then transporting it under vacuum in the reaction chamber.

Description will now be made to a process for producing an electrophotographic light receiving member to be formed by a microwave plasma CVD process.

The deposition device 3100 by the RF CVD process in the production apparatus shown in FIG. 3 is replaced with a deposition device 4100 shown in FIG. 4, which is connected to the raw material gas supply device 3200, to obtain a production apparatus for electrophotographic light receiving members by the μW plasma CVD process having the following constitution shown in FIG. 5.

The apparatus comprises a reaction chamber 4111 having a gas tight vacuum structure, the pressure at the inside of which can be reduced, a raw material supply device 3200, and an exhaust device (not illustrated) for reducing the pressure at the inside of the reaction chamber. At the inside of the reaction chamber 4111, are disposed a microwave introduction window 4112 formed with such a material as capable of efficiently allowing a microwave power to pass therethrough into the reaction chamber and capable of keeping vacuum seal (for instance, quartz glass or alumina ceramics), a microwave guide tube 4113 connected by way of a stub tuner (not illustrated) and an isolator (not illustrated) to a microwave power source (not illustrated), cylindrical substrates 4115 on which deposited films are to be formed, substrate heating heaters 4116, a raw material gas introduction pipe 4117, and an electrode 4118 for applying an external electric bias for controlling the plasma potential. The inside of the reaction chamber 4111 is connected by way of an exhaust pipe 4121 to a diffusion pump not illustrated. The raw material gas supply device 3200 comprises reservoirs 3221–3226 for raw material gases such as $SiH_4$, $GeH_4$, $H_2$, $CH_4$, $B_2H_6$ and $PH_3$, valves 3231–3236, 3241–3246, 3251–3256 and mass flow controllers 3211–3216, in which the reservoir for each of the raw material gases is connected by way of the valve 3260 to the gas introduction pipe 4117 in the reaction chamber. Further, a space 4130 surrounded with the cylindrical substrates 4115 defines a discharging space.

The deposited films can be formed by this apparatus using the microwave CVD process as described below.

At first, the cylindrical substrates 4115 are disposed in the reaction chamber 4111, and are revolved by the driving device 4120, and the inside of the reaction chamber 4111 is evacuated by way of the evacuation pipe 4121 using a not illustrated evacuation device (for example, vacuum pump) to control the pressure inside of the reaction chamber 4111 to lower than $1\times10^{-7}$ Torr. Successively, the temperature for the cylindrical substrates 4111 is heated to and maintained at a predetermined temperature from 20° C. to 500° C. by the substrate heating heaters 4116.

For introducing the raw material gases for forming the deposited films into the reaction chamber 4111, closure of the gas reservoir valves 3231–3236 and the leak valve (not illustrated) of the reaction chamber, as well as opening of the inflow valves 3241–3246, the exit valve 3251–3256 and the auxiliary valve 3260 are confirmed, and then the main valve (not illustrated) is opened to evacuate the inside of the reaction chamber 4111 and the gas pipelines 4122. Then, when the reading on the vacuum gauge reaches about $5\times10^{-6}$ Torr, the auxiliary valve 3260 and the exit valves 3251–3256 are closed.

Subsequently, each of the gases is introduced from each of the gas reservoirs 3221–3226 by opening each of the valves 3231–3236, and the pressure for each of the gases is controlled to 2 kg/cm$^2$ by each of the pressure controllers 3261–3266. Then, each of the inflow valves 3241–3246 is gradually opened to introduce each of the gases into each of the mass flow controllers 3211–3216.

After the setting for the preparation of the film has thus been completed, each of the layers, that is, the charge injection inhibition layer, the photoconductive layer and the surface layer is formed on each of the cylindrical substrates 4115. When the temperature for the cylindrical substrate 4115 reaches a predetermined level, the relevant exit valves 3251–3256 and the auxiliary valve 3260 are gradually opened and predetermined gases are introduced from the gas reservoirs 3221–3226 by way of the gas introduction pipe 4117 into the reaction chamber 4111. Then, each of the raw material gases is controlled to a predetermined flow rate by each of the mass controllers 3211–3216. In this case, the opening degree for the main valve (not illustrated) is controlled such that the pressure at the inside of the discharge space 4130 is set to a predetermined pressure less than 1 Torr while observing the reading on the vacuum gauge (not illustrated). Then, microwave at a frequency of higher than 500 MHz, preferably, 2.45 GHz is generated by a microwave power source (not illustrated) after the pressure has been stabilized, the microwave power source (not illustrated) is set to a desired power, the μW energy is introduced by way of the wave guide tube 4113 and the microwave introduction window 4112 into the discharge space 4130 to take place μW glow discharge. Substantially in parallel therewith, an electric bias such as a DC bias is applied from the power source 4119 to the electrode 4118. Thus, the introduced raw material gases in the discharge space 4130 surrounded with the substrates 4115 are excited and dissociated by the energy of the microwave and predetermined deposition films are formed on the cylindrical substrates 4115. In this case, the substrates are revolved at a desired velocity by a substrate revolving motor 4120 for making the formation of the layer uniform.

After a film of a predetermined thickness has been formed, the supply of the μW power is interrupted, and the exit valve is closed to interrupt the introduction of the gases into the reaction chamber, to complete the formation of the deposited films.

By repeating the similar procedures for several times, a desired light receiving layer having a multi-layered structure is formed.

It will be apparent that all of other exit valves than those for the required gases are closed upon forming the respective layers. Further, in order to avoid the respective gases from remaining in the reaction chamber 4111 and in the pipelines from the exit valves 3251–3256 to the reaction chamber 4111, a procedure of once evacuating the inside of the system to a high vacuum by closing the exit valves 3251–3256, opening the auxiliary valve 3260 and fully opening the main valve (not illustrated) is conducted as required.

It will be apparent that the kind of the gases and the operations for the valves are properly changed in accordance with the conditions for forming the respective layers.

An temperature for the substrate may be effective upon forming the deposited films, and it is desirable that the temperature is from 20° C. to 500° C., preferably, from 50° C. to 480° C. and, more preferably, from 100° C. to 450° C. for attaining satisfactory effect.

The heating for the substrate may be applied by using any of heat generating members specified so as to be operated under vacuum. More specifically, there can be mentioned electric resistance heat generating member such as sheath heater, wire-wound heater, plate heater or ceramic heater, heat radiation lamp heat generating member such as halogen lamp and infrared lamp, and heat generating member having heat exchanging means using liquid, gas or the like as a heat medium. As the material for constituting the surface of the heating means, there can be used metal such as stainless steel, nickel, aluminum or copper, as well as ceramics and heat resistant polymeric resins.

Further, it is possible to adapt a method of disposing a chamber exclusively used for heating in addition to the reaction chamber, heating the substrate and then transporting it under vacuum in the reaction chamber.

In the μW-PCVD process, the pressure in the discharge space is, preferably, from 1 mm Torr to 100 mm Torr, more preferably, from 3 mm Torr to 50 mm Torr and, most preferably, from 5 mm Torr to 30 mm Torr.

It is sufficient that the pressure outside the discharge space is lower than that in the discharge space. If the pressure in the discharge space is lower than 100 mm Torr, in particular, less than 50 mm Torr, the effect for improving the deposited film characteristics is particularly increased if the pressure in the discharge space is as high as more than three times that at the outside of the discharge space.

As a method of introducing the microwaves as far as the reaction furnace, there can be mentioned a method of using a microwave guide tube, and introduction of microwaves into the reaction furnace is conducted by introducing them from one or plurality of dielectric windows. In this case, material used for the introduction window for the microwaves into the furnace, those materials with less microwave loss are usually employed such as alumina ($Al_2O_3$), aluminum nitride (AlN), boronitride (BN), silicon nitride (SiN), silicon carbide (SiC), silicon oxide ($SiO_2$), beryllium oxide (BeO), teflon, polystyrene and the like.

As the electric field to be generated between the electrode and the substrate, a DC electric field is preferred and the electric field is preferably directed from the electrode to the substrate. A mean level for the DC voltage applied to the electrode for generating the electric field is from 15 V to 300 V and, preferably, from 30 to 200 V. There is no particular restriction on the waveform of the DC voltage and various kind of waveforms are effective in the present invention. That is, any of voltage forms may be used so long as the direction of the voltage does not change with time. For instance, in addition to a constant voltage showing no level change with time, a pulselike voltage and a ripple-containing rectified voltage from a rectifier the level of which changes greatly with lapse of time are also effective.

Further, application of an AC voltage is also effective. Alternating current of any frequency can be used and, practically, a low frequency wave of 50 or 60 Hz or a radio frequency wave of 13.56 MHz is suitable. The waveform of the alternating current may be sinusoidal, rectangular waveform or like other waveform. Practically, a sinusoidal waveform is suitable. In this case, the voltage in each of the cases means an effective value.

The size and the shape for the electrode may be determined optionally so long as they do not disturb the electric discharge and, practically, a cylindrical shape with a diameter of 1 mm to 5 cm is preferred. In this case, the length for the electrode can also be set optionally so long as the length of the electrode allows the electric field to be applied uniformly on the substrate.

Any of materials can be used for the electrode so long as the surface of the electrode is made electroconductive and it may usually be employed, for example, metals such as Al, Cr, Mo, Au, In, Nb, Te, V, Ti, Pt, Pd and Fe, alloys thereof, or glass, ceramic or plastic material having a surface applied with an electrifying treatment.

The present invention will now be explained referring to examples.

EXAMPLE 1

Electrophotographic light receiving members were prepared on an aluminum cylinders of 108 mm diameter applied with mirror-face fabrication, by using a production apparatus for electrophotographic light receiving member shown in FIG. 3 under the preparing conditions shown in Table 1(A), in accordance with procedures specifically describe previously. In this case, several kinds of electrophotographic light receiving members were prepared by variously changing the composition of the first photoconductive layer by changing the flow rate of $SiF_4$ (diluted to 100 ppm or 1% with $H_2$) as shown in Table 1(B).

Electrophotographic light receiving members of specimen Nos. 1–44 prepared in this example were set to a copying machine NP 8550 manufactured by Canon Inc. and modified as an electrophotographic apparatus for experiment and electrophotographic characteristics such as appearance of minute blank area (dots), appearance of coarse image and appearance of ghost in the initial images were evaluated. Further, appearance of minute blank area (dots), appearance of coarse image and appearance of ghost after an endurance test of repeating image formation by continuously passing 2,000,000 sheets of A4 size were evaluated under the circumstance at a temperature of 23° C. and at a humidity of 60% with a process speed of 483 mm/sec. The results are shown in Table 2.

The content of fluorine atoms (atomic ppm) in the first photoconductive layer shown in Table 2 shows the result of elemental analysis by SIMS.

Evaluation shown in Table 2 was made for the dots with a diameter of less than 0.2 mm and for the coarse image in view of the image density at 100 sites, each site being a circular region of 0.05 mm diameter as one unit, as the scattering of the image density. For each evaluation, "⊙" represents "excellent", "o" represents "good", "Δ" represents "seems practically acceptable" and "x" represents "practically not acceptable".

As can be seen from Table 2, satisfactory results can be obtained for all the test items by setting the fluorine content within a range from 1 to 95 atomic ppm in the first photoconductive layer.

EXAMPLE 2

Light receiving layers for an electrophotographic light receiving member were formed on an aluminum cylinder of 108 mmø diameter applied with mirror-face fabrication by using the production apparatus for electrophotographic light receiving member by the RF glow discharge process shown in FIG. 3, under the production conditions shown in Table 3(A) in accordance with the procedures as described above specifically. In this case, the $SiF_4$ gas (diluted to 100 ppm or 1% with the He) used for the preparation of the first photoconductive layer was changed as shown in Table 3(B).

When the same test as in Example 1 was applied for the electrophotographic light receiving members of the specimens Nos. 12–19 prepared in this example, the results as shown in Table 3(C) were obtained. The fluorine content in the table shows the results of the elemental analysis by SIMS.

EXAMPLE 3

When electrophotographic light receiving members were prepared in the same way as in Example 1 by using the production apparatus for electrophotographic light receiving member by the RF glow discharge process as shown in FIG. 3, under the preparation conditions shown in Table 4(A) and (B) and the same evaluations were conducted, satisfactory results like that in Example 1 were obtained. The results are shown in Table 4(C). The fluorine content in Table 4(C) shows values obtained by elemental analysis by SIMS.

EXAMPLE 4

When electrophotographic light receiving members were prepared in the same manner as in Example 1, by using the production apparatus for electrophotographic light receiving member by the RF glow discharge process shown in FIG. 3, under the preparation conditions shown in Table 5 and the same evaluations were applied, the results were satisfactory like that in Example 1.

EXAMPLE 5

When electrophotographic light receiving members were prepared in the same manner as in Example 1, by using the production apparatus for electrophotographic light receiving member by the RF glow discharge process shown in FIG. 3, under the preparation conditions shown in Table 6 and the same evaluations were applied, the results were satisfactory like that in Example 1.

EXAMPLE 6

When electrophotographic light receiving members were prepared in the same manner as in Example 1, by using the production apparatus for electrophotographic light receiving member by the RF glow discharge process shown in FIG. 3, under the preparation conditions shown in Table 7 and the same evaluations were applied, the results were satisfactory like that in Example 1.

EXAMPLE 7

When electrophotographic light receiving members were prepared in the same manner as in Example 1, by using the production apparatus for electrophotographic light receiving member by the RF glow discharge process shown in FIG. 3, under the preparation conditions shown in Table 8 and the same evaluations were applied, the results were satisfactory like that in Example 1.

EXAMPLE 8

When electrophotographic light receiving members were prepared in the same manner as in Example 1, by using the production apparatus for electrophotographic light receiving member by the RF glow discharge process shown in FIG. 3, under the preparation conditions shown in Table 9(A) and (B) and the same evaluations were applied, the results were satisfactory like that in Example 1. The results are shown in Table 9(C). The fluorine content in Table 9(C) are values obtained by elemental analysis by SIMS.

EXAMPLE 9

When electrophotographic light receiving members were prepared in the same manner as in Example 1, by using the production apparatus for electrophotographic light receiving member by the RF glow discharge process shown in FIG. 3, under the preparation conditions shown in Table 10 and the same evaluations were applied, the results were satisfactory like that in Example 1.

EXAMPLE 10

When electrophotographic light receiving members were prepared in the same manner as in Example 1, by using the production apparatus for electrophotographic light receiving member by the RF glow discharge process shown in FIG. 3, under the preparation conditions shown in Table 11 and the same evaluations were applied, the results were satisfactory like that in Example 1.

EXAMPLE 11

When electrophotographic light receiving members were prepared in the same manner as in Example 1, by using the production apparatus for electrophotographic light receiving member by the RF glow discharge process shown in FIG. 3, under the preparation conditions shown in Table 12 and the same evaluations were applied, the results were satisfactory like that in Example 1.

EXAMPLE 12

Electrophotographic light receiving members were prepared by forming light receiving layers on aluminum cylinders each of 108 mmø diameter applied with mirror-face fabrication, by using the production apparatus for electrophotographic light receiving member by the μW glow discharge process shown in FIGS. 4 and 5, under the preparation conditions shown in Table 13 in accordance with the procedures described before specifically.

When the same evaluations as in Example 1 were conducted, satisfactory results were obtained. Further, when the electrophotographic light receiving members prepared in Example 12 were subjected to elemental analysis by SIMS, the content of fluorine in the first conductive layer was 40 ppm.

EXAMPLE 13

When electrophotographic light receiving members were prepared in the same manner as in Example 12, by using the production apparatus for electrophotographic light receiving member by the μW glow discharge process as shown in FIGS. 4 and 5, under the preparation conditions shown in Table 14 and evaluated in the same manner as in Example 1, satisfactory results like that in Example 1 were obtained.

EXAMPLE 14

When electrophotographic light receiving members were prepared in the same manner as in Example 12, by using the production apparatus for electrophotographic light receiving member by the μW glow discharge process as shown in FIGS. 4 and 5, under the preparation conditions shown in Table 15 and evaluated in the same manner as in Example 1, satisfactory results like that in Example 1 were obtained.

EXAMPLE 15

When electrophotographic light receiving members were prepared in the same manner as in Example 12, by using the production apparatus for electrophotographic light receiving member by the μW glow discharge process as shown in FIGS. 4 and 5, under the preparation conditions shown in Table 16 and evaluated in the same manner as in Example 1, satisfactory results like that in Example 1 were obtained.

EXAMPLE 16

When electrophotographic light receiving members were prepared in the same manner as in Example 12, by using the production apparatus for electrophotographic light receiving member by the μW glow discharge process as shown in FIGS. 4 and 5, under the preparation conditions shown in Table 17 and evaluated in the same manner as in Example 1, satisfactory results like that in Example 1 were obtained.

EXAMPLE 17

When electrophotographic light receiving members were prepared in the same manner as in Example 12, by using the production apparatus for electrophotographic light receiving member by the μW glow discharge process as shown in FIGS. 4 and 5, under the preparation conditions shown in Table 18 and evaluated in the same manner as in Example 1, satisfactory results like that in Example 1 were obtained.

EXAMPLE 18

When electrophotographic light receiving members were prepared in the same manner as in Example 12, by using the production apparatus for electrophotographic light receiving member by the μW glow discharge process as shown in FIGS. 4 and 5, under the preparation conditions shown in Table 19 and evaluated in the same manner as in Example 1, satisfactory results like that in Example 1 were obtained.

Since the electrophotographic light receiving member according to the present invention has a specific layer constitution as described above, it can thoroughly overcome the problems in the prior art electrophotographic light receiving members constituted by a-Si and the member exhibits extremely excellent electric characteristics, optical characteristics, photoconductive characteristics, image characteristics, durability and use-environmental characteristics.

In particular, in the present invention, since the photoconductive layer has a two-layer structure comprising a non-SiC and a non-Si layers disposed from the side of the conductive substrate, important functions of the electrophotographic light receiving member, that is, generation of photo-carriers and transportation of the thus generated photo-carriers are shared individually to each of separate layers, so that the degree of freedom for the design of the layer can be made greater and the characteristics become more excellent than in a case where only one single layer is responsible to both of such functions. Further, since the dielectric constant of the light receiving layer can be reduced by incorporating carbon atoms in the photoconductive layer, the static capacitance per layer thickness can be reduced to provide high chargeability and a remarkable improvement in the photosensitivity, as well as high voltage resisting capacity can be improved and the durability is also improved. Then, disposition of the photoconductive layer containing carbon atoms on the side of the substrate, adhesion between the substrate and the photoconductive layer can be improved to reduce the peeling of the film or occurrence of the fine minute defects, to thereby improve the yield in the productivity.

In addition, in the present invention, since the fluorine atoms (F) are incorporated by a very small amount (from 1 atomic ppm to 95 atomic ppm) at least in the no-SiC photoconductive layer, dangling bonds, for example, of the silicon atoms (S) and the carbon atoms (C) can be compensated and, in particular, since coagulation of the carbon atoms and/or hydrogen atoms can be suppressed in a case of incorporating the hydrogen atoms together with the carbon atoms, a more stable state can be attained in view of the matrix structure. Accordingly, strains in the deposited films can be corrected and, as a result, image characteristics such as appearance of minute blank area (dots), appearance of coarse image and the like can be improved, making it possible to obtain high quality images with a clear half tone and at high resolution power stably and repeatedly.

EXAMPLE 19

Electrophotographic light receiving members were prepared on an aluminum cylinder of 108 mm diameter applied with mirror face fabrication, by using the production apparatus for electrophotographic light receiving member by the RF glow discharge process as shown in FIG. 3, in accordance with the procedures as described specifically above, under the preparation conditions shown in Table 20. In this example, the flow rate of $CO_2$ (diluted to 500 ppm or 5% with He) and/or $SiF_4$ (diluted to 100 ppm or 1% with $H_2$) to be introduced upon forming the first photoconductive layer was varied so as to change the oxygen content and the fluorine content in the first conductive layer. Then, the oxygen content and the fluorine content in the first photoconductive layer were determined by SIMC elemental analysis (Cameca IMS-3F).

Measurement (I)

The thus prepared electrophotographic light receiving members were set to a copying machine NP-8550 manufactured by Canon Inc. and modified as an electrophotographic apparatus for experiment and evaluation was applied for the electrophotographic characteristics such as the amount of potential shift, sensitivity, white dots, coarse image and ghost before the endurance test, as well as the number of occurrence of spherical protrusions on the surface of the electrophotographic light receiving members. Each of the test times were evaluated by the following method.

Measurement for the Number of Spherical Protrusion

The entire surface area of the thus prepared electrophotographic light receiving members was observed by an optical microscope and the number of spherical protrusions with a diameter of greater than 20 μm was examined in an area of 100 $cm^2$. Then, a relative evaluation was conducted as compared with the results obtained by the same method for the number of the spherical protrusions of the electrophotographic light receiving members prepared using neither $CO_2$ nor $SiF_4$ in the photoconductive layer, while assuming the result for the latter as 100. The results are shown in Table 20(B).

Measurement for Sensitivity-Potential Shift

Sensitivity: After charging an electrophotographic light receiving member to a surface potential in a dark area of 400 V, an optical image was immediately irradiated. As the optical image, a Xenon lamp light source was used and light after cutting light in a wavelength region of less than 550 nm by using a filter was irradiated. In this case, the surface potential at a bright area of the electrophotographic light receiving member was measured by a surface potential meter and the amount of exposure was controlled such that the surface potential at the bright area was at a 50 V potential and the sensitivity was defined as the amount of exposure in this case.

Potential Shift: an electrophotographic light receiving member was set to an experimental device and corona charging was conducted by applying a high voltage of +6 KV to a charger, and the surface potential at the dark area of the electrophotographic receiving member was measured by the surface potential member. Then, the amount of the potential shift was defined as a difference between Vdo for the surface potential in the dark area when a voltage was started to be applied to the charger and Vd for the surface potential in the dark area after lapse of 2 min.

For each of the sensitivity and the potential shift, the content of the oxygen in the first photoconductive layer was changed while setting the fluorine content at 50 atomic ppm in the first photoconductive layer, and a relative evaluation was conducted as compared with the sensitivity and the amount of the potential shift of the electrophotographic light receiving member prepared by using none of $CO_2$, $SiF_4$ in the first photoconductive layer.

That is, assuming the sensitivity as (A) and the amount of the potential shift as (B) for the electrophotographic light receiving member prepared by using none of $SO_2$ and $SiF_4$, while assuming the sensitivity as (C) and the amount of the potential shift as (D) respectively while varying the oxygen content and keeping the fluorine content constant at 50 atomic ppm in the first photoconductive layer, each of the following relations was plotted relative to the oxygen content.

(C)/(A)×100 (%) (D)/(B)×100 (%)

Figure 6:
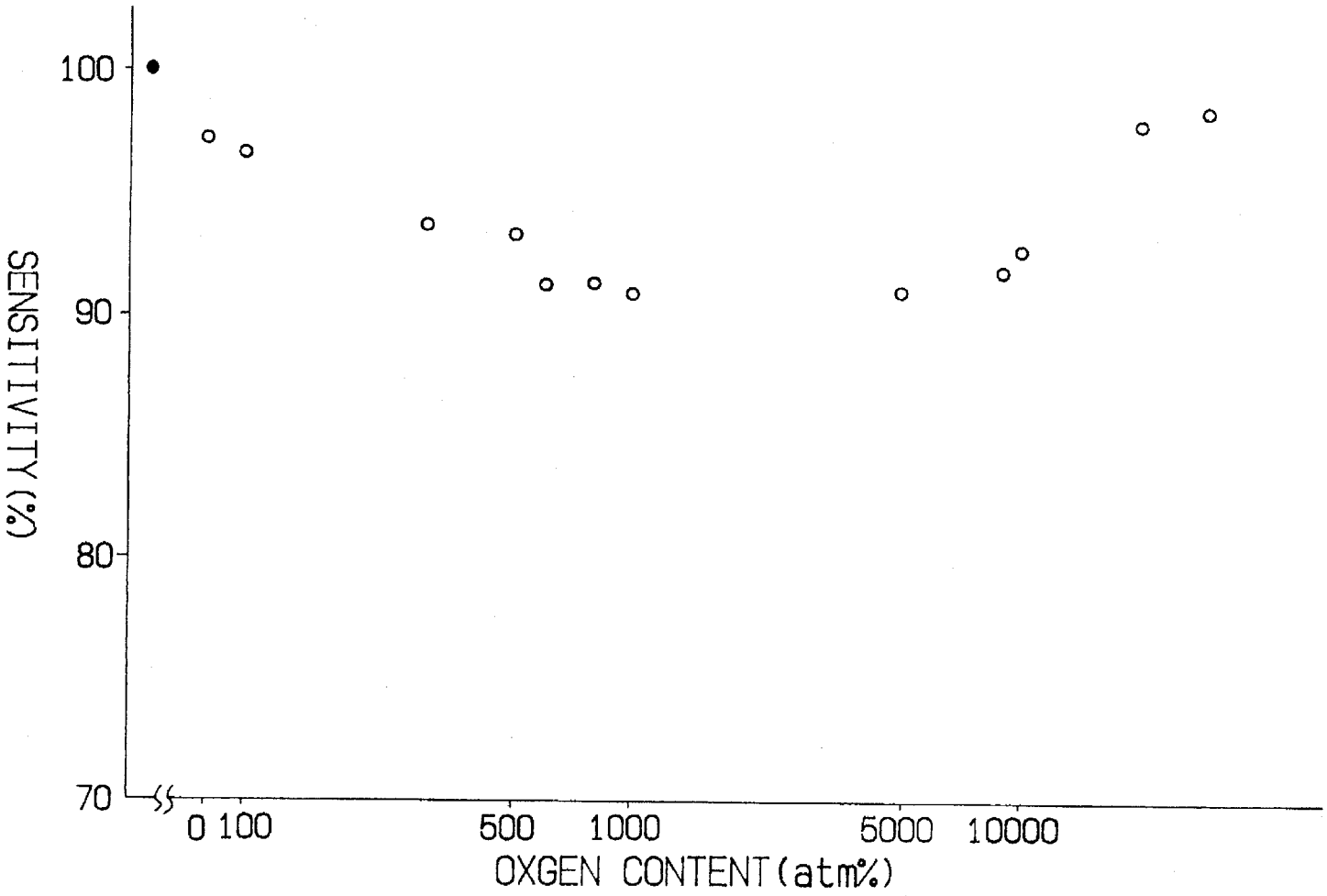
FIG. 6 is a graphic chart showing a relationship between the oxygen content in the first photoconductive layer and the sensitivity of the light receiving member according to the present invention.
Figure 7:
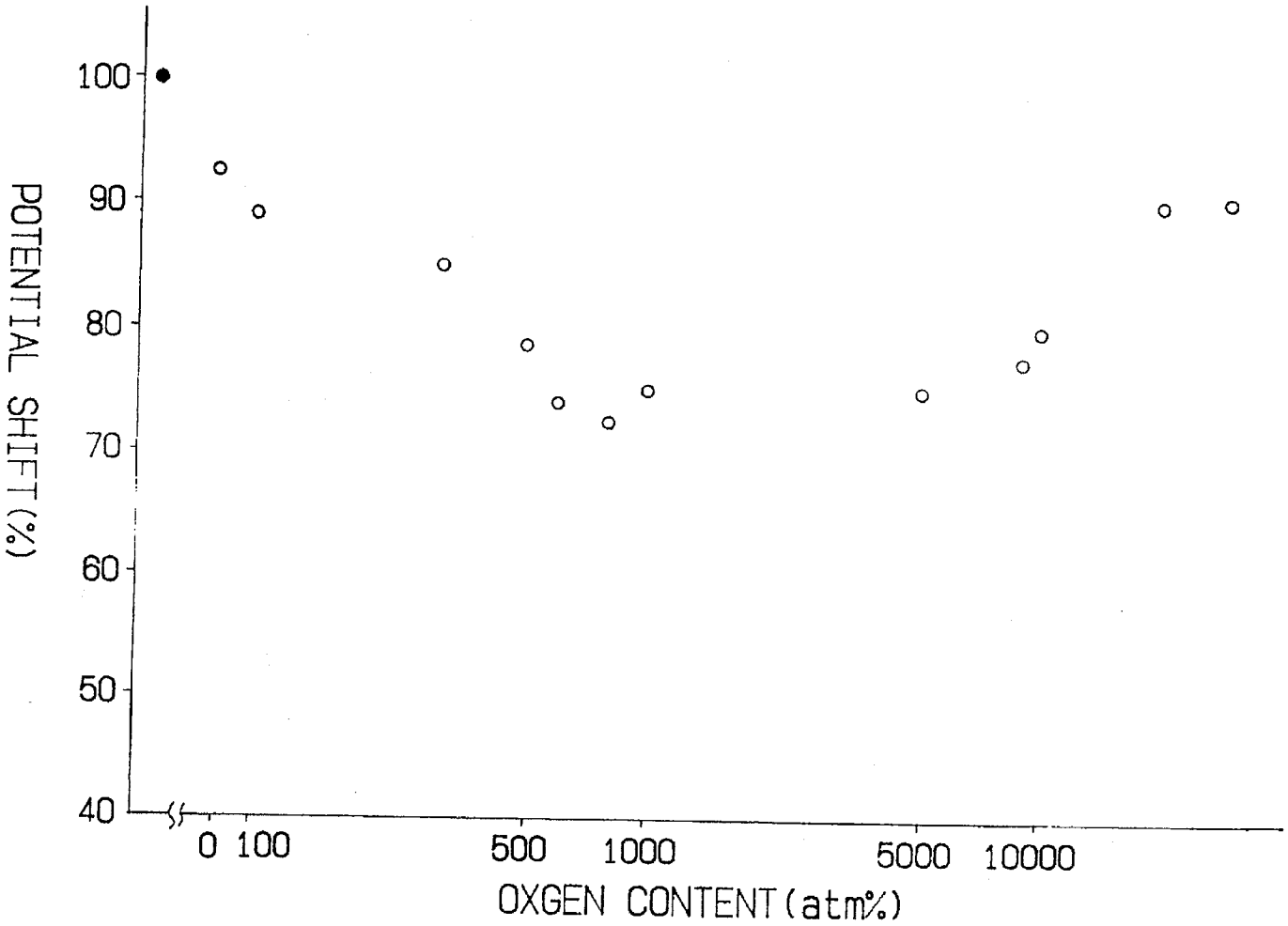
FIG. 7 is a graphic chart showing a relationship between the oxygen content in the first photoconductive layer and the potential shift.

The results are shown in FIGS. 6 and 7. In this case, the sensitivity and the potential shift are more excellent as the numerical values are smaller, and it has been found that the sensitivity and the potential shift showed satisfactory values within the range of the oxygen content from 600 atomic ppm to 10,000 ppm in the first photoconductive layer.

Quite the same results were obtained for each of the sensitivity and the potential shift when the fluorine content in the first photoconductive layer was changed within a range of less than 95 atomic ppm. On the other hand, it has also been found that the sensitivity becomes lowered if the fluorine content exceeds 95 atomic ppm.

Measurement (II): Test After Endurance Use

The electrophotographic light receiving members prepared as described above were set to a copying machine NP8550, manufactured by Canon Inc. and modified as an electrophotographic apparatus for experiment and an endurance test was conducted for 2,500,000 sheets. Specifically, a test chart manufactured by Canon Inc. (Part No.:TC-1) was put on an original platen of the electrophotographic apparatus, and images were formed continuously for 2,500,000 cycles for A4 sized paper (canon paper: NP-DRY) under N/N circumstance (at a temperature of 23° C. and a humidity of 60%) with a process speed of 484 mm/sec.

Then, electrophotographic characteristics for the sensitivity and the potential shift were evaluated.

Measurement for Sensitivity-Potential Shift

The sensitivity and the amount of potential shift were measured in the same manner as in the Measurement (I), and the ratio of change for each of them was examined before and after the endurance test.

$$\frac{\text{(value after endurance test)} - \text{(value before endurance test)}}{\text{(Value before endurance test)}} \times 100(\%)$$

Figure 8:
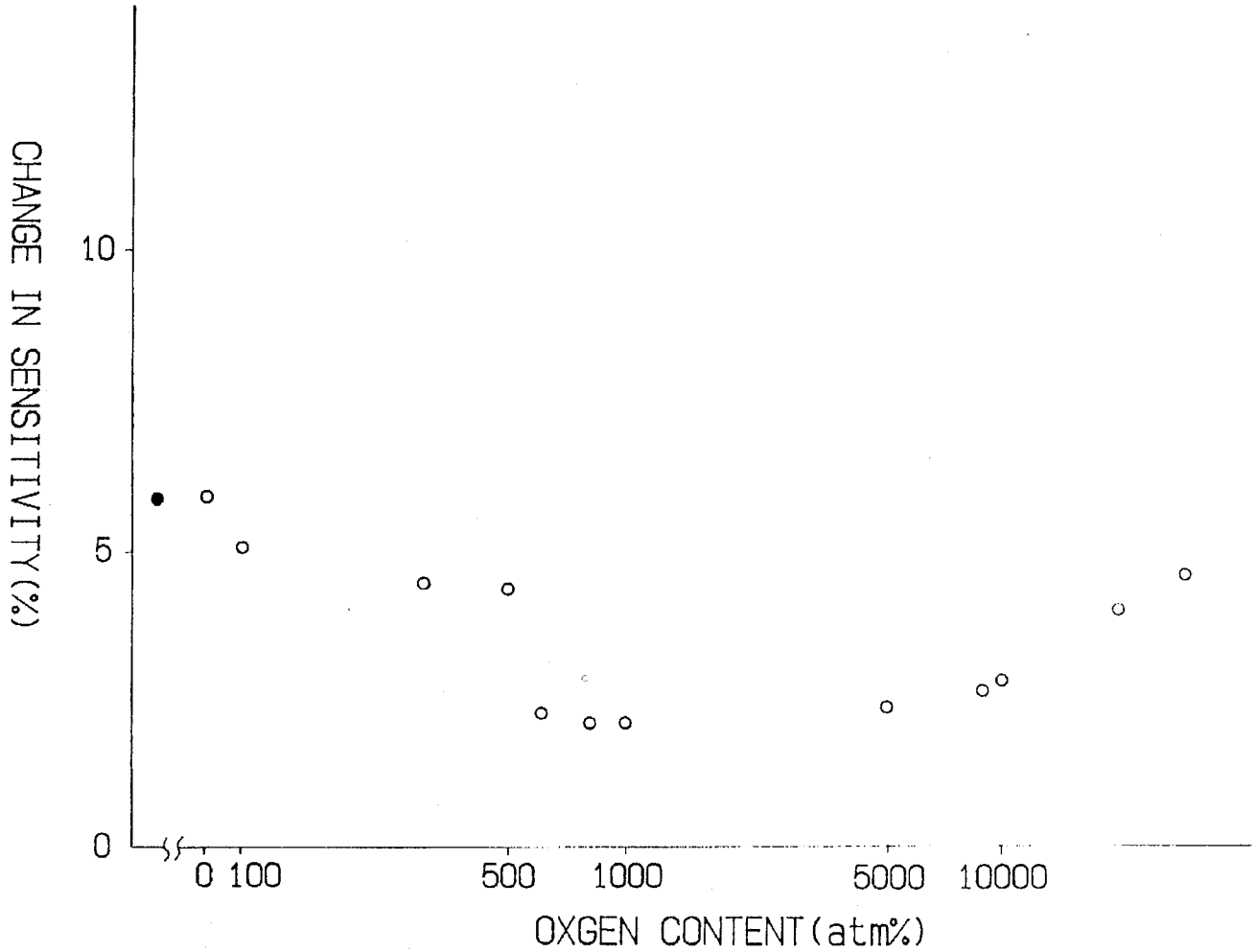
FIG. 8 is a graphic chart showing a relationship between the oxygen content in the first photoconductive layer and the change of sensitivity before and after repeated use.
Figure 9:
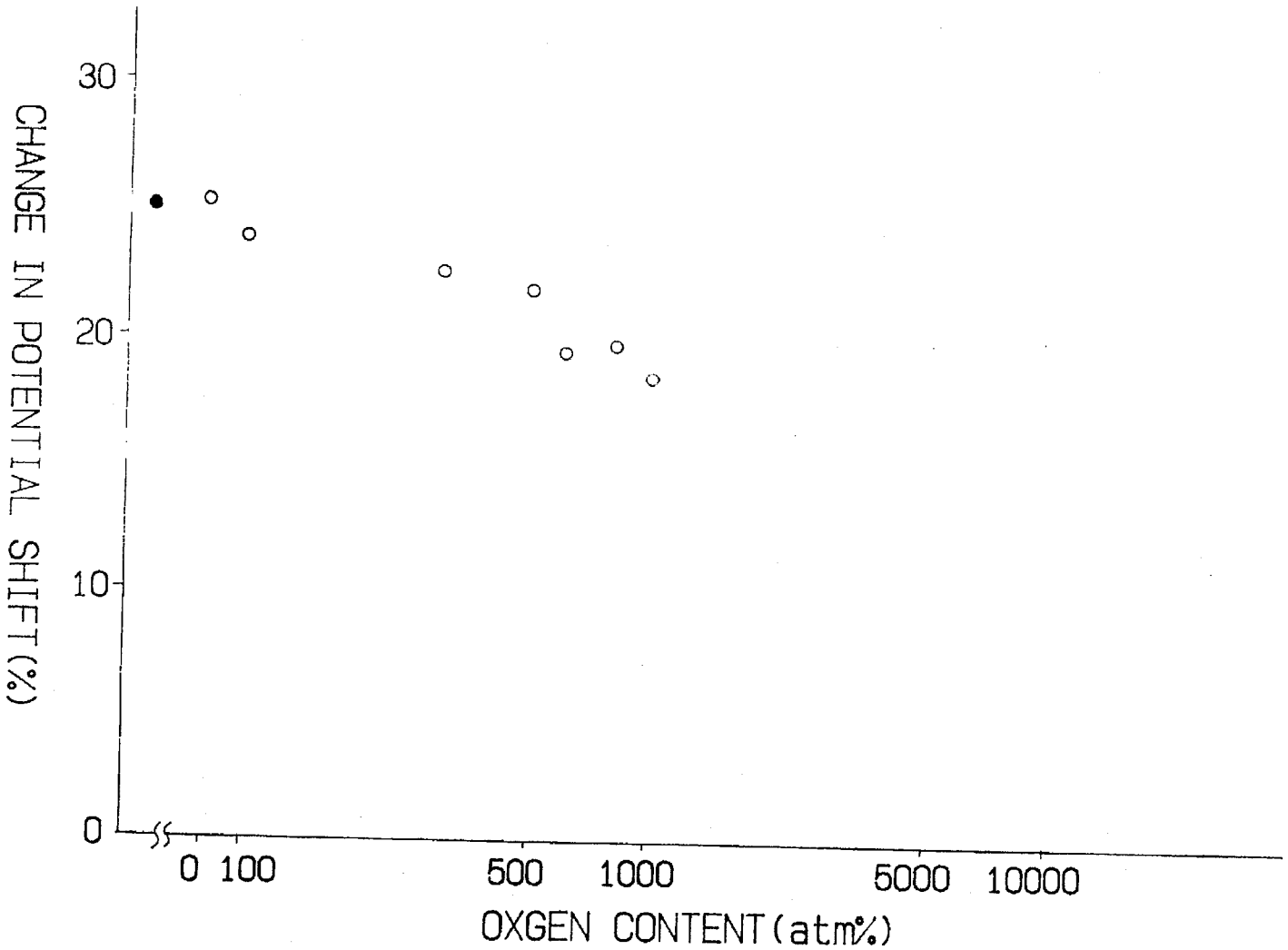
FIG. 9 is a graphic chart showing a relationship between the oxygen content in the first photoconductive layer and the amount of a potential shift before and after the repeated use.

The results are shown in FIGS. 8 and 9.

FIGS. 8 and 9 show the results when the oxygen content in the first photoconductive layer was changed while setting the fluorine content constant at 50 atomic ppm in the first photoconductive layer. It can be seen as in FIGS. 8 and 9 that there was less change in the sensitivity and the potential shift due to continuous use, within the range of the oxygen content from 600 atomic ppm to 10,000 atomic ppm in the first photoconductivity layer.

Further, quite the same results as above could be obtained for each of the sensitivity and the potential shift when the fluorine content in the first photoconductive layer was changed within a range of less than 95 atomic ppm. On the other hand, it has been found that if the fluorine content exceeds 95 atomic ppm, the sensitivity change was increased.

From the results shown in Tables 2 and 8 and FIGS. 6–9, it has been experimentally demonstrated that setting the fluorine content within a range from 1 to 95 atomic ppm and the oxygen content within a range from 600 to 10,000 atomic ppm in the first photoconductive layer is extremely effective regarding the surface potential characteristics, image characteristics and durability.

Further, when a cleaning blade and a separation finger were observed by a microscope on every 200,000 sheets during accelerated endurance test respectively, it has been found that the cleaning blade was scarcely damaged and the abrasion of the separation finger was extremely small in the electrophotographic light receiving member according to the present invention.

Further, as a result of the examination made to a case in which oval marks were increased for the causes of such increase after the endurance test, it has been found that they are attributable to the following two reasons.

1. Spherical protrusions are detached by frictional contact with a cleaning blade or transfer paper.
2. Paper dusts of transfer paper are deposited on a separation charger and the charger causes abnormal discharge to localize the potential in the light receiving member, thereby inducing insulation breakdown of the film.

However, none of the two phenomena occurred at all in the electrophotographic light receiving member according to the present invention.

Further, when an endurance test was conducted for 2,500,000 sheets by using regenerated paper in the same manner as in the measurement (II) in this example, no increase for minute blank area was observed in the electrophotographic light receiving member according to the present invention.

Further, when the occurrence of white dots, coarse image and ghost after the endurance use was measured by the same procedures as those in Example 1, it has been found that a remarkable improvement could be obtained only when the content of the fluorine atoms incorporated in the first photoconductive layer was set within a range from 0.5 atomic ppm to 95 atomic ppm based on the silicon atoms as in Example 1.

EXAMPLE 20

Electrophotographic light receiving members were prepared on an aluminum cylinder of 108 mm diameter applied with mirror-face fabrication, by using the production apparatus for electrophotographic light receiving member by the RF glow discharge process as shown in FIG. 3, in accordance with the procedures as described above specifically, under the preparation conditions shown in Table 21. In this experiment, the electric power introduced upon forming the surface layer and the flow rate of $H_2$ or $SiF_4$ were varied so as to change the flow rate of the hydrogen atoms and the flow rate of the fluorine atoms incorporated into the surface layer.

The electrophotographic light receiving members thus prepared were set to a copying machine NP-8550, manufactured by Canon Inc. and modified into a photographic apparatus for experiment and evaluation was conducted for three items, that is, residual potential, sensitivity and image flow by the methods shown below.

Residual Potential: An electrophotographic light receiving member was charged to a surface potential of 400 V in a dark area, and an optical image was irradiated thereon after 0.2 sec. A xenon lamp light source was used as the optical image and light after cutting light in a wavelength region of less than 550 nm by using a filter was irradiated at a does of 1.5 lux.sec. In this case, the surface potential in the bright area of the electrophotographic light receiving member was measured by the surface potential meter. The results are shown in Table 22.

Sensitivity: An electrophotographic light receiving member was charged to the surface potential of 400 V in a dark area. Immediately, an optical image was irradiated. A xenon lamp light source was used as the optical image and light after cutting light in a wavelength region of less than 550 nm by using the filter was irradiated. In this case, the surface potential in a bright area of the electrophotographic light receiving member was measured by the surface potential meter. The exposure amount was adjusted such that the surface potential in the bright area was at a potential of 50 V, and the sensitivity was defined by the exposure amount in this case. The results are shown in Table 22.

Smudging: A test chart manufactured by Canon Inc. comprising letters printed on the entire surface of a white background (part No. FI-9058) was placed on an original platen and light was irradiated at a dose of 1.5 lux.sec to reproduce copies. Resultant copy images were observed and evaluated as to whether fine lines on the images were continuous or not. If there was unevenness on the images, evaluation was made regarding the entire image region and the results were shown for the worst portion. The results are shown in Table 22.

As apparent from Table 22, it has been found that satisfactory results were obtained both for the residual potential and the sensitivity and, further, the image flow under the intense exposure could be suppressed remarkably by setting the sum of the hydrogen content and the fluorine content in the surface layer within a range of 30 to 70 atomic % and the content of the fluorine within a range of less than 20 atomic %.

EXAMPLE 21

Light receiving layers were formed on an aluminum cylinder of 108 mm diameter applied with mirror-face finishing, by using the production apparatus for electrophotographic light receiving member by the RF glow discharge process as shown in FIG. 3, in accordance with the procedures as described above specifically, under the preparation conditions shown in Table 23(A) and (B), to prepare specimen Nos. 36–44 of electrophotographic light receiving members.

Measurement was conducted for the occurrence of "spherical protrusions" in the same procedures as in Example 19 for the specimens No. 36–44. The results are shown in Table 23.

EXAMPLE 22

When electrophotographic light receiving members were prepared in the same manner as in Example 21, by using the production apparatus for electrophotographic light receiving member by the RF glow discharge process as shown in FIG. 3, under the preparation conditions shown in Table 24 (A) and (B) and the same evaluations were conducted, the results were satisfactory like that in Example 21. The results are shown in Table 24 (C).

EXAMPLE 23

When electrophotographic light receiving members were prepared in the same manner as in Example 21, by using the production apparatus for electrophotographic light receiving member by the RF glow discharge process as shown in FIG. 3, under the preparation conditions shown in Table 25 and the same evaluations were conducted, the results were satisfactory like that in Example 21.

EXAMPLE 24

When electrophotographic light receiving members were prepared in the same manner as in Example 21, by using the production apparatus for electrophotographic light receiving member by RF glow discharge process as shown in FIG. 3, under the preparation conditions shown in Table 26 (A) and (B) and the same evaluations were conducted, the results were satisfactory like that in Example 21. The results are shown in Table 26 (C).

EXAMPLE 25

When electrophotographic light receiving members were prepared in the same manner as in Example 21, by using the production apparatus for electrophotographic light receiving member by the RF glow discharge process as shown in FIG. 3, under the preparation conditions shown in Table 27 and the same evaluations were conducted, the results were satisfactory like that in Example 21.

EXAMPLE 26

When electrophotographic light receiving members were prepared in the same manner as in Example 21, by using the production apparatus for electrophotographic light receiving member by the RF glow discharge process as shown in FIG. 3, under the preparation conditions shown in Table 28 and the same evaluations were conducted, the results were satisfactory like that in Example 21.

EXAMPLE 27

Electrophotographic light receiving members were prepared in the same manner as in Example 21, by using the production apparatus for electrophotographic light receiving member by the RF glow discharge process as shown in FIG. 3, under the preparation conditions shown in Table 29. When the durability of the thus prepared electrophotographic light receiving members was evaluated by using a copying machine NP-8550, manufactured by Canon Inc. and modified into a negatively charging constitution, satisfactory results like that in Example 21 were obtained.

EXAMPLE 28

Electrophotographic light receiving members were prepared by forming light receiving layers on aluminum cylinders each of 108 mm diameter applied with mirror-face fabrication, by using the production apparatus for electrophotographic light receiving member, by the μW glow discharge process as shown in FIGS. 4 and 5, in accordance with the procedures as described above specifically, under the preparation conditions shown in Table 30. When the same evaluation as in Example 21 was conducted, satisfactory results could be obtained.

As a result of the elemental analysis conducted by SIMC (Cameca IMS-3F) for the electrophotographic light receiving members prepared in Example 28, the fluorine content was 50 ppm and the oxygen content was 800 atomic ppm in the first photoconductive layer.

EXAMPLE 29

When electrophotographic light receiving members were prepared in the same manner as in Example 28, by using the production apparatus for electrophotographic light receiving member by the μW plow discharge process shown in FIGS. 4 and 5, under the preparation conditions shown in Table 31 and the same evaluation as in Example 21 was conducted, satisfactory results like those in Example 21 were obtained.

EXAMPLE 30

When electrophotographic light receiving members were prepared in the same manner as in Example 28, by using the production apparatus for electrophotographic light receiving member by the μW glow discharge process shown in FIGS. 4 and 5, under the preparation conditions shown in Table 32 and the same evaluation as in Example 21 was conducted, satisfactory results like those in Example 21 were obtained.

EXAMPLE 31

When electrophotographic light receiving members were prepared in the same manner as in Example 28, by using the production apparatus for electrophotographic light receiving member by the μW glow discharge process shown in FIGS. 4 and 5, under the preparation conditions shown in Table 33 and the same evaluation as in Example 21 was conducted, satisfactory results like those in Example 21 were obtained.

EXAMPLE 32

When electrophotographic light receiving members were prepared in the same manner as in Example 28, by using the production apparatus for electrophotographic light receiving member by the μW glow discharge process shown in FIGS. 4 and 5, and under the preparation conditions shown in Table 34 and the same evaluation as in Example 21 was conducted, satisfactory results like those in Example 21 were obtained.

EXAMPLE 33

When electrophotographic light receiving members were prepared in the same manner as in Example 28, by using the production apparatus for electrophotographic light receiving member by the μW glow discharge process shown in FIGS. 4 and 5, under the preparation conditions shown in Table 34 and the same evaluation as in Example 21 was conducted, satisfactory results like those in Example 21 were obtained.

EXAMPLE 34

When electrophotographic light receiving members were prepared in the same manner as in Example 28, by using the production apparatus for electrophotographic light receiving member by the μW glow discharge process shown in FIGS. 4 and 5, under the preparation conditions shown in Table 35 and the same evaluation as in Example 21 was conducted, satisfactory results like those in Example 21 were obtained.

Since the light receiving member according to the present invention has a specific layer structure as described above, it can overcome all of the problems in the prior art electrophotographic light receiving members constituted with A-Si and exhibits extremely excellent electric characteristics, optical characteristics, photoconductive characteristics, image characteristics, endurance and use-environmental characteristics.

In particular, in the present invention, since the photoconductive layer has a two-layer structure comprising a non-SIC and a non-Si layers disposed from the side of the conductive substrate, important functions of the electrophotographic light receiving member, that is, generation of photo-carriers and transportation of the thus generated photo-carriers are shared individually to each of separate layers, so that the degree of freedom for the design of the layer can be made greater and the characteristics become more excellent than in a case where only one single layer is responsible to both of such functions. Further, since the dielectric constant of the light receiving layer can be reduced by incorporating carbon atoms in the photoconductive layer, the static capacitance per layer thickness can be reduced to provide high chargeability and a remarkable improvement in the photosensitivity, as well as resistance to high voltage can be improved and the durability is also improved. Then, disposition of the photoconductive layer containing carbon atoms on the side of the substrate, adhesion between the substrate and the photoconductive layer can be improved to reduce the peeling of the film or occurrence of the fine minute defects, to thereby improve the yield in the productivity.

In addition, in the present invention, strains in the deposited films can be moderated to suppress the occurrence of structural defects in the film, as well as decrease the occurrence of abnormal growth due to the synergistic effect obtained by incorporating fluorine atoms (F) in a small amount (from 1 to 95 atomic ppm based on silicon atom) and, further, by incorporating oxygen atoms (O) within a range from 600 to 1000 atoms based on silicon atoms at least in the non-SiC photoconductive layer.

As a result, remarkable improvement can be attained, in particular, for the image characteristics, for example, appearance of minute blank area, appearance of coarse image and appearance of ghost described above, as well as the durability can be improved drastically while maintaining such excellent characteristics in the electrophotographic process.

Further, the surface layer in the present invention can improve the mechanical strength or the electric voltage withstand, can effectively inhibit the injection of charges from the surface upon undergoing a charging treatment, so that the chargeability, use-environmental characteristics, durability and electric voltage withstand can be improved. Further, since the light absorption in the surface layer is reduced, the sensitivity can be improved and, since the accumulation of carriers between the photoconductive layer and the surface layer is reduced, the image flow can be suppressed while maintaining a high chargeability.

In particular, in the present invention, the durability can be improved outstandingly while maintaining the electrical characteristics of the light receiving member at a high level, by setting the range of the oxygen content in A-SiC to the above mentioned range. That is, since the strains of the film can effectively be moderated and the film adhesion can be improved, the extent of spherical growth defect can be reduced outstandingly, so that the damages given to the cleaning blade or the separation finger are reduced even after continuous formation of images in a great amount, to make the cleaning performance and the separability of the transfer paper satisfactory. Accordingly, the durability as the image-forming device can be improved remarkably.

Further, since the high voltage capacity can also be improved, occurrence of leak dots caused by the insulation breakdown to a part of the light receiving member is further retarded.

TABLE 1 (A)

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 500 | 500 | 0.5 | 250 | 20 |
| | $CH_4$ | 100 | | | | |
| | $SiF_4/H_3$ | * | | | | |
| second photoconductive layer | $SiH_4$ | 500 | 500 | 0.5 | 250 | 3 |
| surface layer | $SiH_4$ | 30 | 300 | 0.3 | 250 | 0.5 |
| | $CH_4$ | 500 | | | | |

Note: *is shown in Table 1 (B)

TABLE 1 (B)

| Sample No. | 1 | 2 | 3 | 4 | 5 | 6 | 7 | 8 | 9 | 10 | 11 |
|---|---|---|---|---|---|---|---|---|---|---|---|
| flow rate of $SiF_4/H_2$ (sccm) | 0 | 12.5 | 25 | 50 | 125 | 250 | 5 | 12.5 | 23.8 | 25 | 125 |
| | | | $SiF_4/H_2$ = 100 ppm | | | | | $SiF_4/H_2$ = 1% | | | |

TABLE 2

| Sample No. | | 1 | 2 | 3 | 4 | 5 | 6 | 7 | 8 | 9 | 10 | 11 |
|---|---|---|---|---|---|---|---|---|---|---|---|---|
| content of fluorine in the first photoconductive layer (atomic ppm) | | 0 | 0.5 | 1 | 2 | 5 | 10 | 20 | 50 | 95 | 100 | 500 |
| initial image | dots | Δ | Δ | ○ | ○ | ◎ | ◎ | ◎ | ◎ | ◎ | ◎ | ◎ |
| | coarse image | ○ | ○ | ○ | ○ | ◎ | ◎ | ◎ | ◎ | ◎ | ◎ | ◎ |
| | ghost | ◎ | ◎ | ◎ | ◎ | ◎ | ◎ | ◎ | ◎ | ◎ | Δ | Δ |
| image after copying shots | dots | X | Δ | ○ | ○ | ◎ | ◎ | ◎ | ○ | Δ | X | X |
| | coarse image | X | Δ | ○ | ○ | ◎ | ◎ | ◎ | ◎ | ○ | X | X |
| | ghost | ○ | ○ | ○ | ○ | ◎ | ◎ | ◎ | ◎ | ○ | X | X |

TABLE 3 (A)

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 500 | 0.4 | 250 | 20 |
| | $H_2$ | 500 | | | | |
| | $CH_4$ | 100 | | | | |
| | $SiF_4$/He | * | | | | |
| second photoconductive layer | $SiH_4$ | 300 | 300 | 0.4 | 250 | 3 |
| | $H_2$ | 300 | | | | |
| surface layer | $SiH_4$ | 50 | 150 | 0.3 | 250 | 0.5 |
| | $CH_4$ | 500 | | | | |

Note: *is shown in Table 3 (B)

TABLE 3 (B)

| Sample No. | 12 | 13 | 14 | 15 | 16 | 17 | 18 | 19 |
|---|---|---|---|---|---|---|---|---|
| flow rate of $SiF_4$/He (sccm) | 0 | 7.5 | 15 | 4.5 | 7.5 | 14.3 | 15 | 75 |
| | | $SiF_4$/He = 100 ppm | | | $SiF_4$/He = 1% | | | |

TABLE 3 (C)

| Sample No. | | 12 | 13 | 14 | 15 | 16 | 17 | 18 | 19 |
|---|---|---|---|---|---|---|---|---|---|
| content of fluorine in the first photoconductive layer (atomic ppm) | | 0 | 0.5 | 1 | 30 | 50 | 95 | 100 | 500 |
| initial image | dots | Δ | Δ | ○ | ⊙ | ⊙ | ⊙ | ⊙ | ⊙ |
| | coarse image | ○ | ○ | ○ | ⊙ | ⊙ | ⊙ | ⊙ | ⊙ |
| | ghost | ⊙ | ⊙ | ⊙ | ⊙ | ⊙ | ⊙ | ○ | Δ |
| image after copying shots | dots | X | Δ | ○ | ⊙ | ○ | Δ | X | X |
| | coarse image | X | Δ | ○ | ⊙ | ⊙ | ○ | X | X |
| | ghost | ○ | ○ | ○ | ⊙ | ⊙ | ○ | X | X |

TABLE 4 (C)

| Sample No. | | 20 | 21 | 22 | 23 | 24 | 25 | 26 | 27 |
|---|---|---|---|---|---|---|---|---|---|
| content of fluorine in the first photoconductive layer (atomic ppm) | | 0 | 0.5 | 1 | 30 | 50 | 95 | 100 | 500 |
| initial image | dots | Δ | Δ | ⊙ | ⊙ | ⊙ | ⊙ | ⊙ | ⊙ |
| | coarse image | ○ | ○ | ○ | ⊙ | ⊙ | ⊙ | ⊙ | ⊙ |
| | ghost | ⊙ | ⊙ | ⊙ | ⊙ | ⊙ | ⊙ | ○ | Δ |
| image after copying shots | dots | X | Δ | ○ | ⊙ | ○ | Δ | X | X |
| | coarse image | X | Δ | ○ | ⊙ | ⊙ | ○ | X | X |
| | ghost | ○ | ○ | ○ | ⊙ | ⊙ | ○ | X | X |

TABLE 4 (A)

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 500 | 0.4 | 250 | 20 |
| | $H_2$ | 500 | | | | |
| | $CH_4$ | 70 | | | | |
| | $SiF_4$/He | * | | | | |
| second photoconductive layer | $SiH_4$ | 300 | 300 | 0.4 | 250 | 3 |
| | $H_2$ | 500 | | | | |
| surface layer | $SiH_4$ | 30 | 200 | 0.3 | 250 | 0.5 |
| | $NH_4$ | 300 | | | | |

Note: *is shown in Table 4 (B)

TABLE 4(B)

| Sample No. | 20 | 21 | 22 | 23 | 24 | 25 | 26 | 27 |
|---|---|---|---|---|---|---|---|---|
| flow rate of $SiF_4$/He (sccm) | 0 | 75 | 15 | 4.5 | 7.5 | 14.3 | 15 | 75 |
| | | $SiF_4/H_2$ = 100 ppm | | | $SiF_4$/He = 1% | | | |

TABLE 5

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 200 | 200 | 0.4 | 300 | 20 |
| | $H_2$ | 500 | | | | |
| | $CH_4$ | 100 | | | | |
| | $SiF_4$ (against $SiH_4$) | 60 ppm | | | | |
| second photoconductive layer | $SiH_4$ | 300 | 300 | 0.4 | 250 | 3 |
| | $H_2$ | 300 | | | | |
| surface layer | $SiH_4$ | 30 | 300 | 0.3 | 250 | 0.5 |
| | NO | 100 | | | | |

TABLE 6

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 500 | 0.4 | 250 | 20 |
| | $H_2$ | 500 | | | | |
| | $CH_4$ | 100 | | | | |
| | $SiF_4$ (against $SiH_4$) | 80 ppm | | | | |
| second photoconductive layer | $SiH_4$ | 300 | 300 | 0.4 | 250 | 3 |
| | $H_2$ | 300 | | | | |
| surface layer | $SiH_4$ | 30 | 200 | 0.3 | 250 | 0.5 |
| | $CO_2$ | 100 | | | | |
| | $NH_4$ | 100 | | | | |

TABLE 7

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 500 | 0.5 | 250 | 20 |
| | $H_2$ | 500 | | | | |
| | $CH_4$ | 100 | | | | |
| | $SiF_4$ (against $SiH_4$) | 50 ppm | | | | |
| | $B_2H_6$ (against $SiH_4$) | 5 ppm | | | | |
| second photoconductive layer | $SiH_4$ | 300 | 300 | 0.4 | 250 | 3 |
| | $H_2$ | 300 | | | | |
| | $B_2H_6$ (against $SiH_4$) | 1.5 ppm | | | | |
| surface layer | $SiH_4$ | 50 | 150 | 0.3 | 250 | 0.5 |
| | $CH_4$ | 500 | | | | |

TABLE 8

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 300 | 0.5 | 250 | 20 |
| | $H_2$ | 500 | | | | |
| | $CH_4$ | 100 | | | | |
| | $SiF_4$ | 70 ppm | | | | |

TABLE 8-continued

| name of layer | gas & its flow rate (sccm) | RF power (W) | inner pressure (Torr) | substrate temperature (°C.) | layer thickness (μm) |
|---|---|---|---|---|---|
| | (against $SiH_4$)<br>$B_2H_6$ 5 ppm<br>(against $SiH_4$) | | | | |
| second photoconductive layer | $SiH_4$ 300<br>$H_2$ 300<br>$SiF_4$ 50 ppm<br>(against $SiH_4$)<br>$B_2H_6$ 2 ppm<br>(against $SiH_4$) | 300 | 0.4 | 250 | 3 |
| surface layer | $SiH_4$ 50<br>$CH_4$ 500<br>$SiF_4$ 10 | 200 | 0.3 | 250 | 0.5 |

TABLE 9 (A)

| name of layer | gas & its flow rate (sccm) | RF power (W) | inner pressure (Torr) | substrate temperature (°C.) | layer thickness (μm) |
|---|---|---|---|---|---|
| first photoconductive layer | $SiH_4$ 150<br>$CH_4$ 50<br>$B_2H_6$ 2000 ppm<br>(against $SiH_4$) | 200 | 0.3 | 250 | 2 |
| first Photoconductive layer | $SiH_4$ 300<br>$H_2$ 1000<br>$CH_4$ 100<br>$SiF_4$/He *<br>$B_2H_6$ 7 ppm<br>(against $SiH_4$) | 700 | 0.5 | 250 | 25 |
| second photoconductive layer | $SiF_4$ 200<br>$H_2$ 500<br>$B_2H_6$ 1 ppm<br>(against $SiH_4$) | 500 | 0.4 | 250 | 2 |
| surface layer | $SiH_4$ 50<br>$CH_4$ 600 | 200 | 0.3 | 250 | 0.5 |

Note: * is shown in Table 9 (B)

TABLE 9 (B)

| Sample No. | 28 | 29 | 30 | 31 | 32 | 33 | 34 | 35 |
|---|---|---|---|---|---|---|---|---|
| flow rate of $SiF_4/H_2$ (sccm) | 0 | 6.8 | 13.5 | 4 | 6.8 | 12.8 | 13.5 | 67.5 |
| | $SiF_4$/He = 100 ppm | | | $SiF_4$/He = 1% | | | | |

TABLE 9 (C)

| Sample No. | | 28 | 29 | 30 | 31 | 32 | 33 | 34 | 35 |
|---|---|---|---|---|---|---|---|---|---|
| content of fluorine in the first photoconductive layer (atomic ppm) | | 0 | 0.5 | 1 | 30 | 50 | 95 | 100 | 500 |
| initial image | dots | Δ | Δ | ◎ | ◎ | ◎ | ◎ | ◎ | ◎ |
| | coarse image | ○ | ○ | ○ | ◎ | ◎ | ◎ | ◎ | ◎ |
| | ghost | ◎ | ◎ | ◎ | ◎ | ◎ | ◎ | ○ | Δ |
| image after copying shots | dots | X | Δ | ○ | ◎ | ○ | Δ | X | X |
| | coarse image | X | Δ | ○ | ◎ | ◎ | ○ | X | X |
| | ghost | ○ | ○ | ○ | ◎ | ◎ | ○ | X | X |

TABLE 10

| name of layer | gas & its flow rate (sccm) | RF power (W) | inner pressure (Torr) | substrate temperature (°C.) | layer thickness (μm) |
|---|---|---|---|---|---|
| charge injection inhibition layer | $SiH_4$ 200<br>$CH_4$ 50<br>$H_2$ 500<br>NO 5<br>$SiF_4$ 80 ppm<br>(against $SiH_4$)<br>$B_2H_6$ 2000 ppm<br>(against $SiH_4$) | 300 | 0.4 | 250 | 2 |

TABLE 10-continued

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 500 | 1000 | 0.4 | 250 | 20 |
| | $H_2$ | 1000 | | | | |
| | $CH_4$ | 100 | | | | |
| | $SiF_4$ | 80 ppm (against $SiH_4$) | | | | |
| | $B_2H_6$ | 10→1 ppm (against $SiH_4$) (being decreased at a constant rate) | | | | |
| second photoconductive layer | $SiH_4$ | 500 | 500 | 0.4 | 250 | 3 |
| | $H_2$ | 500 | | | | |
| | $SiF_4$ | 80 ppm (against $SiH_4$) | | | | |
| | $B_2H_6$ | 1 ppm (against $SiH_4$) | | | | |
| surface layer | $SiH_4$ | 50 | 300 | 0.3 | 250 | 0.5 |
| | $CH_4$ | 200 | | | | |
| | NO | 50 | | | | |

TABLE 11

| name of layer | gas & its flow rate (sccm) | | RF power (W) | inner pressure (Torr) | substrate temperature (°C.) | layer thickness (μm) |
|---|---|---|---|---|---|---|
| charge injection inhibition layer | $SiH_4$ | 300 | 700 | 0.5 | 300 | 5 |
| | $C_2H_2$ | 50 | | | | |
| | $H_2$ | 1000 | | | | |
| | $SiF_4$ | 5 ppm (against $SiH_4$) | | | | |
| | $B_2H_6$ | 3000 ppm (against $SiH_4$) | | | | |
| first photoconductive layer | $SiH_4$ | 300 | 700 | 0.5 | 300 | 25 |
| | $H_2$ | 1500 | | | | |
| | $C_2H_2$ | 50 | | | | |
| | $SiF_4$ | 50 ppm (against $SiH_4$) | | | | |
| | $B_2H_6$ | 6 ppm (against $SiH_4$) | | | | |
| second photoconductive layer | $SiH_4$ | 300 | 300 | 0.4 | 300 | 5 |
| | $H_2$ | 300 | | | | |
| | $B_2H_6$ | 2 ppm (against $SiH_4$) | | | | |
| surface layer | $SiH_4$ | 50 | 200 | 0.4 | 300 | 0.5 |
| | $CH_4$ | 500 | | | | |

TABLE 12

| name of layer | gas & its flow rate (sccm) | | RF power (W) | inner pressure (Torr) | substrate temperature (°C.) | layer thickness (μm) |
|---|---|---|---|---|---|---|
| charge injection inhibition layer | $SiH_4$ | 200 | 300 | 0.4 | 250 | 3 |
| | $CH_4$ | 50 | | | | |
| | $H_2$ | 500 | | | | |
| | $SiF_4$ | 70 ppm (against $SiH_4$) | | | | |
| | $PH_3$ | 1000 ppm (against $SiH_4$) | | | | |
| first photoconductive layer | $SiH_4$ | 300 | 500 | 0.4 | 250 | 20 |
| | $H_2$ | 1000 | | | | |
| | $CH_4$ | 50 | | | | |
| | $SiF_4$ | 50 ppm (against $SiH_4$) | | | | |
| | $PH_3$ | 0.5 ppm (against $SiH_4$) | | | | |

TABLE 12-continued

| name of layer | gas & its flow rate (sccm) | | RF power (W) | inner pressure (Torr) | substrate temperature (°C.) | layer thickness (μm) |
|---|---|---|---|---|---|---|
| second photoconductive layer | $SiH_4$ | 300 | 300 | 0.4 | 250 | 2 |
| | $H_2$ | 300 | | | | |
| | $SiF_4$ | 30 ppm (against $SiH_4$) | | | | |
| surface layer | $SiH_4$ | 50 | 200 | 0.3 | 250 | 0.5 |
| | $CH_4$ | 300 | | | | |
| | $SiF_4$ | 80 | | | | |
| | NO | 5 | | | | |

TABLE 13

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| first photoconductive layer | $SiH_4$ | 500 | 1200 | 50 | 10 | 300 | 25 |
| | $CH_4$ | 100 | | | | | |
| | $H_4$ | 1500 | | | | | |
| | He | 1000 | | | | | |
| | $SiF_4$ (against $SiH_4$) | 100 ppm | | | | | |
| | $B_2H_6$ (against $SiH_4$) | 5 ppm | | | | | |
| second photoconductive layer | $SiH_4$ | 300 | 1200 | 50 | 7 | 300 | 5 |
| | He | 2000 | | | | | |
| | $SiF_4$ (against $SiH_4$) | 50 ppm | | | | | |
| | $B_2H_6$ (against $SiH_4$) | 3 ppm | | | | | |
| surface layer | $SiH_4$ | 70 | 1000 | 70 | 5 | 300 | 0.5 |
| | $CH_4$ | 500 | | | | | |

TABLE 14

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 500 | 1000 | 60 | 10 | 350 | 3 |
| | $CH_4$ | 100 | | | | | |
| | $H_2$ | 1000 | | | | | |
| | He | 1000 | | | | | |
| | $SiF_4$ (against $SiH_4$) | 50 ppm | | | | | |
| | $B_2H_6$ (against $SiH_4$) | 500 ppm | | | | | |
| first photoconductive layer | $SiH_4$ | 300 | 1000 | 50 | 10 | 350 | 25 |
| | $CH_4$ | 30 | | | | | |
| | $H_2$ | 1500 | | | | | |
| | He | 2000 | | | | | |
| | $SiF_4$ (against $SiH_4$) | 50 ppm | | | | | |
| | $B_2H_6$ (against $SiH_4$) | 5 ppm | | | | | |
| second photoconductive layer | $SiH_4$ | 300 | 1000 | 50 | 10 | 350 | 5 |
| | $H_2$ | 500 | | | | | |
| | $SiF_4$ (against $SiH_4$) | 50 ppm | | | | | |
| surface layer | $SiH_4$ | 100 | 1000 | 80 | 7 | 350 | 0.5 |
| | $CH_4$ | 500 | | | | | |
| | $SiF_4$ | 50 | | | | | |

TABLE 15

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 500 | 1000 | 60 | 10 | 350 | 3 |
| | $CH_4$ | 100 | | | | | |
| | $H_2$ | 1000 | | | | | |
| | He | 1000 | | | | | |
| | $SiF_4$ (against $SiH_4$) | 50 ppm | | | | | |
| | $B_2H_6$ (against $SiH_4$) | 500 ppm | | | | | |
| first photoconductive layer | $SiH_4$ | 300 | 1000 | 50 | 10 | 350 | 25 |
| | $CH_4$ | 30 | | | | | |
| | $H_2$ | 1500 | | | | | |

TABLE 15-continued

| name of layer | gas & its flow rate (sccm) | μW power (W) | bias voltage (V) | inner pressure (mTorr) | substrate temperature (°C.) | layer thickness (μm) |
|---|---|---|---|---|---|---|
| | He 2000<br>$SiF_4$ 50 ppm (against $SiH_4$)<br>$B_2H_6$ 5 ppm (against $SiH_4$) | | | | | |
| second photoconductive layer | $SiH_4$ 300<br>$H_2$ 500<br>$SiF_4$ 50 ppm (against $SiH_4$) | 1000 | 50 | 10 | 350 | 5 |
| surface layer | $SiH_4$ 100<br>$CH_4$ 300<br>NO 100<br>$SiF_4$ 50 | 1000 | 70 | 7 | 350 | 0.5 |

TABLE 16

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 400<br>$CH_4$ 100<br>$H_2$ 1500<br>He<br>$SiF_4$ 80 ppm (against $SiH_4$)<br>$B_2H_6$ 1000 ppm (against $SiH_4$) | 1000 | 50 | 10 | 350 | 3 |
| first photoconductive layer | $SiH_4$ 300<br>$CH_4$ 50<br>$H_2$ 2000<br>He 1000<br>$SiF_4$ 80 ppm (against $SiH_4$)<br>$B_2H_6$ 10 ppm (against $SiH_4$) | 1000 | 50 | 7 | 350 | 25 |
| second photoconductive layer | $SiH_4$ 300<br>$SiF_4$ 80 ppm (against $SiH_4$)<br>$B_2H_6$ 1 ppm (against $SiH_4$) | 1000 | 50 | 10 | 350 | 3 |
| surface layer | $SiH_4$ 50<br>$CH_4$ 300<br>$SiF_4$ 50 | 1000 | 100 | 5 | 350 | 0.5 |

TABLE 17

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 400<br>$CH_4$ 100<br>$H_2$ 1500<br>He<br>$SiF_4$ 80 ppm (against $SiH_4$)<br>$B_2H_6$ 1000 ppm (against $SiH_4$) | 1000 | 50 | 10 | 350 | 3 |
| first photoconductive layer | $SiH_4$ 300<br>$CH_4$ 50<br>$H_2$ 2000<br>He 1000<br>$SiF_4$ 80 ppm | 1000 | 50 | 7 | 350 | 25 |

TABLE 17-continued

| name of layer | gas & its flow rate (sccm) | μW power (W) | bias voltage (V) | inner pressure (mTorr) | substrate temperature (°C.) | layer thickness (μm) |
|---|---|---|---|---|---|---|
| | (against $SiH_4$)<br>$B_2H_6$ 10 ppm<br>(against $SiH_4$) | | | | | |
| second photoconductive layer | $SiH_4$ 300<br>$B_2H_6$ 1 ppm<br>(against $SiH_4$)<br>He 2000 | 1000 | 50 | 10 | 350 | 5 |
| surface layer | $SiH_4$ 50<br>$CH_4$ 300<br>$SiF_4$ 50<br>He 2000 | 1000 | 100 | 5 | 350 | 0.5 |

TABLE 18

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 400<br>$CH_4$ 200<br>$H_2$ 1000<br>He 2000<br>$SiF_4$ 100 ppm<br>(against $SiH_4$)<br>$B_2H_6$ 500 ppm<br>(against $SiH_4$) | 1000 | 60 | 10 | 350 | 3 |
| first photoconductive layer | $SiH_4$ 300<br>$CH_4$ 50<br>$H_2$ 1500<br>He 2000<br>$SiF_4$ 100 ppm<br>(against $SiH_4$)<br>$B_2H_6$ 6 ppm<br>(against $SiH_4$) | 1000 | 60 | 9 | 350 | 25 |
| second photoconductive layer | $SiH_4$ 300<br>$B_2H_6$ 2 ppm<br>(against $SiH_4$)<br>He 3500 | 900 | 60 | 10 | 350 | 7 |
| surface layer | $SiH_4$ 90<br>$CH_4$ 500<br>$SiF_4$ 30<br>He 3500 | 900 | 100 | 10 | 350 | 0.5 |

TABLE 19

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 400<br>$CH_4$ 200<br>$H_2$ 1000<br>He 2000<br>$SiF_4$ 100 ppm<br>(against $SiH_4$)<br>$B_2H_6$ 500 ppm<br>(against $SiH_4$)<br>NO 300 ppm<br>(against $SiH_4$) | 900 | 60 | 10 | 350 | 3 |
| first photoconductive layer | $SiH_4$ 300<br>$CH_4$ 50<br>He 1500<br>He 2000<br>$SiF_4$ 100 ppm<br>(against $SiH_4$)<br>$B_2H_6$ 6 ppm<br>(against $SiH_4$) | 900 | 60 | 9 | 350 | 25 |

TABLE 19-continued

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| | NO | 300 ppm (against $SiH_4$) | | | | | |
| second photoconductive layer | $SiH_4$ | 300 | 900 | 60 | 10 | 350 | 7 |
| | $B_2H_6$ | 2 ppm (against $SiH_4$) | | | | | |
| | He | 3500 | | | | | |
| | NO | 100 ppm (against $SiH_4$) | | | | | |
| surface layer | $SiH_4$ | 90 | 900 | 100 | 10 | 350 | 0.5 |
| | $CH_4$ | 500 | | | | | |
| | $SiF_4$ | 30 | | | | | |
| | He | 3500 | | | | | |
| | NO | 300 ppm (against $SiH_4$) | | | | | |

TABLE 20 (A)

| name of layer | gas & its flow rate (sccm) | | RF power (W) | inner pressure (Torr) | substrate temperature (°C.) | layer thickness (μm) |
|---|---|---|---|---|---|---|
| first photo-conductive layer | $SiH_4$ | 500 | 500 | 0.5 | 250 | 20 |
| | $CH_4$ | 100 | | | | |
| | $SiF_4/H_2$ | * | | | | |
| | $CO_2$/He | * | | | | |
| second photo-conductive layer | $SiH_4$ | 500 | 500 | 0.5 | 250 | 3 |
| surface layer | $SiH_4$ | 30 | 300 | 0.3 | 250 | 0.5 |
| | $CH_4$ | 500 | | | | |

Note: *is shown in Table 20 (B)

TABLE 20 (B)

(extent of special growth defect)

| content of oxygen (atomic ppm) | content of flourine (atomic ppm) 0 | 0.5 | 1 | 2 | 5 | 10 | 20 | 50 | 95 | 100 | 500 |
|---|---|---|---|---|---|---|---|---|---|---|---|
| 0 | Δ | Δ | Δ | Δ | Δ | Δ | Δ | Δ | Δ | Δ | Δ |
| 100 | Δ | Δ | Δ | Δ | Δ | Δ | Δ | Δ | Δ | Δ | Δ |
| 300 | Δ | Δ | Δ | Δ | Δ | Δ | Δ | Δ | Δ | Δ | Δ |
| 500 | Δ | Δ | Δ | Δ | Δ | Δ | Δ | Δ | Δ | Δ | Δ |
| 600 | Δ | ○ | ○ | ○ | ○ | ○ | ○ | ○ | ○ | Δ | Δ |
| 800 | Δ | ○ | ○ | ○ | ○ | ○ | ⊙ | ○ | ○ | Δ | Δ |
| 1000 | Δ | ○ | ○ | ○ | ○ | ⊙ | ⊙ | ○ | ○ | Δ | Δ |
| 3000 | Δ | ○ | ○ | ○ | ○ | ⊙ | ⊙ | ○ | ○ | Δ | Δ |
| 5000 | Δ | ○ | ○ | ○ | ⊙ | ⊙ | ⊙ | ○ | ○ | Δ | Δ |
| 9000 | Δ | ○ | ○ | ○ | ○ | ○ | ⊙ | ○ | ○ | Δ | Δ |
| 10000 | Δ | ○ | ○ | ○ | ○ | ○ | ○ | ○ | ○ | Δ | Δ |
| 11000 | Δ | Δ | Δ | Δ | Δ | Δ | Δ | Δ | Δ | Δ | Δ |
| 12000 | Δ | Δ | Δ | Δ | Δ | Δ | Δ | Δ | Δ | Δ | Δ |

⊙: less than 60%, excellent image reproduction
○: from 80 to 60%, good image reproduction
Δ: from 100 to 80%, unacceptable image reproduction

TABLE 21

| name of layer | gas & its flow rate (sccm) | | RF power (W) | inner pressure (Torr) | substrate temperature (°C.) | layer thickness (μm) |
|---|---|---|---|---|---|---|
| first photo-conductive layer | $SiH_4$ | 500 | 500 | 0.5 | 250 | 20 |
| | $CH_4$ | 100 | | | | |
| | $SiF_4$ | 50 ppm (against $SiH_4$) | | | | |
| | $CO_2$ | 800 ppm (against $SiH_4$) | | | | |
| second photo-conductive layer | $SiH_4$ | 500 | 500 | 0.5 | 250 | 3 |
| surface layer | $SiH_4$ | 30 | | 0.3 | 250 | 0.5 |
| | $CH_4$ | 500 | | | | |
| | $H_2$ | | | | | |
| | $SiF_4$ | | | | | |

TABLE 22

| content of hydrogen (atomic %) | 11 | | | 21 | | | 30 | | | | 48 | | | | 61 | | | 70 | | 76 |
|---|---|---|---|---|---|---|---|---|---|---|---|---|---|---|---|---|---|---|---|---|
| content of fluorine (atomic %) | 0 | 18 | 24 | 0 | 15 | 23 | 0 | 9 | 18 | 23 | 0 | 11 | 19 | 23 | 0 | 8 | 12 | 0 | 4 | 0 |
| sum of the contents for hydrogen and fluorine (atomic %) | 11 | 29 | 35 | 21 | 36 | 44 | 30 | 39 | 48 | 53 | 48 | 59 | 67 | 71 | 61 | 69 | 73 | 70 | 74 | 76 |
| sensitivity | Δ | Δ | ○ | Δ | ○ | ○ | ○ | ○ | ○ | ○ | ○ | ○ | ○ | Δ | ○ | ○ | Δ | ○ | Δ | Δ |
| residual potential | Δ | Δ | Δ | Δ | ○ | Δ | ○ | ○ | ○ | Δ | ○ | ○ | ○ | Δ | ○ | ○ | Δ | ○ | ○ | Δ |
| smeared image | ○ | ⊙ | ⊙ | ○ | ⊙ | ⊙ | ○ | ⊙ | ⊙ | ⊙ | ○ | ⊙ | ⊙ | ⊙ | ○ | ⊙ | ⊙ | ○ | ⊙ | ○ |
| total evaluation | Δ | Δ | Δ | Δ | ⊙ | Δ | ○ | ⊙ | ⊙ | Δ | ○ | ⊙ | ⊙ | Δ | ○ | ⊙ | Δ | ○ | Δ | Δ |

⊙: excellent
○: good
Δ: practically acceptable

TABLE 23 (A)

| name of layer | gas & its flow rate (sccm) | | RF power (W) | inner pressure (Torr) | substrate temperature (°C.) | layer thickness (μm) |
|---|---|---|---|---|---|---|
| first photo-conductive layer | $SiH_4$ | 300 | 500 | 0.4 | 250 | 20 |
| | $H_2$ | 500 | | | | |
| | $CH_4$ | 100 | | | | |
| | $SiF_4$/He | * | | | | |
| | $CO_2$/He | * | | | | |
| second photo-conductive layer | $SiH_4$ | 300 | 300 | 0.4 | 250 | 3 |
| | $H_2$ | 300 | | | | |
| surface layer | $SiH_4$ | 50 | 150 | 0.3 | 250 | 0.5 |
| | $CH_4$ | 500 | | | | |
| | $SiF_4$ | 10 | | | | |

Note: *is shown in Table 23 (B)

TABLE 23 (B)

| Sample No. | 36 | 37 | 38 | 39 | 40 | 41 | 42 | 43 | 44 |
|---|---|---|---|---|---|---|---|---|---|
| flow rate of $SiF_4$ (sccm) | 0 | 0 | 13.5 | 6.8 | 13.5 | 6.8 | 12.8 | 12.8 | 13.5 |
| flow rate of $CO_2$ (sccm) | 0 | 72 | 0 | 72 | 60 | 60 | 120 | 132 | 120 |
| | $SiF_4$/He = 100 ppm $CO_2$/He = 5000 ppm | | | | | $SiF_4$/He = 1% $CO_2$/He = 5% | | | |

TABLE 23 (C)

| Sample No. | 36 | 37 | 38 | 39 | 40 | 41 | 42 | 43 | 44 |
|---|---|---|---|---|---|---|---|---|---|
| content of fluorine in the first photoconductive layer (atomic ppm) | 0 | 0 | 10 | 0.5 | 10 | 50 | 95 | 95 | 100 |
| content of oxygen in the first photoconductive layer (atomic ppm) | 0 | 600 | 0 | 600 | 5000 | 5000 | 10000 | 11000 | 10000 |
| extent of sperical growth defect | Δ | Δ | Δ | ○ | ⊙ | ⊙ | ○ | Δ | Δ |

⊙: excellent
○: good
Δ: unacceptable

TABLE 24 (A)

| name of layer | gas & its flow rate (sccm) | | RF power (W) | inner pressure (Torr) | substrate temperature (°C.) | layer thickness (μm) |
|---|---|---|---|---|---|---|
| first photoconductive layer | $SiH_4$ | 300 | 500 | 0.5 | 250 | 20 |
| | $H_2$ | 500 | | | | |
| | $CH_4$ | 100 | | | | |
| | $SiF_4$/He | * | | | | |
| | $B_2H_6$ (against $SiH_4$) | 5 ppm | | | | |
| | $CO_2$/He | * | | | | |
| second photoconductive layer | $SiH_4$ | 300 | 300 | 0.4 | 250 | 3 |
| | $H_2$ | 300 | | | | |
| | $B_2H_6$ (against $SiH_4$) | 1.5 ppm | | | | |
| surface layer | $SiH_4$ | 50 | 150 | 0.3 | 250 | 0.5 |
| | $CH_4$ | 500 | | | | |
| | $H_2$ | 50 | | | | |
| | $CF_4$ (against $SiH_4$) | 5 | | | | |

Note: *is shown in Table 24 (B)

TABLE 24 (B)

| Sample No. | 45 | 46 | 47 | 48 | 49 | 50 | 51 | 52 | 53 |
|---|---|---|---|---|---|---|---|---|---|
| flow rate of $SiF_4$/He (sccm) | 0 | 0 | 13.5 | 6.8 | 13.5 | 6.8 | 12.8 | 12.8 | 13.5 |
| flow rate of $CO_2$/He (sccm) | 0 | 72 | 0 | 72 | 60 | 60 | 120 | 132 | 120 |
| | | $SiF_4$/He = 100 ppm $CO_2$/He = 5000 ppm | | | | | $SiF_4$/He = 1% $CO_2$/He = 5% | | |

TABLE 24 (C)

| Sample No. | 45 | 46 | 47 | 48 | 49 | 50 | 51 | 52 | 53 |
|---|---|---|---|---|---|---|---|---|---|
| content of fluorine in the first photoconductive layer (atomic ppm) | 0 | 0 | 10 | 0.5 | 10 | 50 | 95 | 95 | 100 |
| content of oxygen in the first photoconductive layer (atomic ppm) | 0 | 600 | 0 | 600 | 5000 | 5000 | 10000 | 11000 | 10000 |
| extent of sperical growth defect | Δ | Δ | Δ | ○ | ⊙ | ⊙ | ○ | Δ | Δ |

⊙: excellent
○: good
Δ: unacceptable

TABLE 25

| name of layer | gas & its flow rate (sccm) | | RF power (W) | inner pressure (Torr) | substrate temperature (°C.) | layer thickness (μm) |
|---|---|---|---|---|---|---|
| first photo-conductive layer | $SiH_4$ | 300 | 300 | 0.5 | 250 | 20 |
| | $H_2$ | 500 | | | | |
| | $CH_4$ | 100 | | | | |
| | $SiF_4$ (against $SiH_4$) | 70 ppm | | | | |
| | $B_2H_6$ (against $SiH_4$) | 5 ppm | | | | |
| | $CO_2$ (against $SiH_4$) | 1500 ppm | | | | |
| second photo-conductive layer | $SiH_4$ | 300 | 300 | 0.4 | 250 | 3 |
| | $H_2$ | 300 | | | | |
| | $SiF_4$ (against $SiH_4$) | 500 ppm | | | | |
| | $B_2H_6$ (against $SiH_4$) | 2 ppm | | | | |
| surface layer | $SiH_4$ | 50 | 150 | 0.3 | 250 | 0.5 |
| | $CH_4$ | 500 | | | | |
| | $SiF_4$ (against $SiH_4$) | 20 | | | | |

TABLE 26 (A)

| name of layer | gas & its flow rate (sccm) | | RF power (W) | inner pressure (Torr) | substrate temperature (°C.) | layer thickness (μm) |
|---|---|---|---|---|---|---|
| charge injection inhibition layer | $SiH_4$ | 150 | 200 | 0.3 | 250 | 2 |
| | $CH_4$ | 50 | | | | |
| | $B_2H_6$ (against $SiH_4$) | 2000 ppm | | | | |
| first photoconductive layer | $SiH_4$ | 300 | 700 | 0.5 | 250 | 25 |
| | $H_2$ | 1000 | | | | |
| | $CH_4$ | 100 | | | | |
| | $SiF_4$/He | * | | | | |
| | $B_2H_6$ (against $SiH_4$) | 7 ppm | | | | |
| | $CO_2$/He | * | | | | |
| second photoconductive layer | $SiF_4$ | 300 | 500 | 0.4 | 250 | 2 |
| | $H_2$ | 500 | | | | |
| | $B_2H_6$ (against $SiH_4$) | 1 ppm | | | | |
| surface layer | $SiH_4$ | 50 | 200 | 0.3 | 250 | 0.5 |
| | $CH_4$ | 600 | | | | |
| | $SiF_4$ | 20 | | | | |

Note: *is shown in Table 26 (B)

TABLE 26 (B)

| Sample No. | 54 | 55 | 56 | 57 | 58 | 59 | 60 | 61 | 62 |
|---|---|---|---|---|---|---|---|---|---|
| flow rate of $SiF_4$/He (sccm) | 0 | 0 | 120 | 6 | 120 | 6 | 11.4 | 11.4 | 12 |
| flow rate of $CO_2$/He | 0 | 72 | 0 | 72 | 60 | 60 | 120 | 132 | 120 |

TABLE 26 (B)-continued

| Sample No. | 54 | 55 | 56 | 57 | 58 | 59 | 60 | 61 | 62 |
|---|---|---|---|---|---|---|---|---|---|
| (sccm) | | | | | | | | | |
| | | | $SiF_4$/He = 100 ppm $CO_2$/He = 5000 ppm | | | | $SiF_4$/He = 1% $CO_2$/He = 5% | | |

TABLE 26 (C)

| Sample No. | 54 | 55 | 56 | 57 | 58 | 59 | 60 | 61 | 62 |
|---|---|---|---|---|---|---|---|---|---|
| content of fluorine in the first photoconductive layer (atomic ppm) | 0 | 0 | 10 | 0.5 | 10 | 50 | 95 | 95 | 100 |
| content of oxygen in the first photoconductive layer (atomic ppm) | 0 | 600 | 0 | 600 | 5000 | 5000 | 10000 | 11000 | 10000 |
| extent of sperical growth defect | Δ | Δ | Δ | ○ | ⊙ | ⊙ | ○ | Δ | Δ |

⊙: excellent
○: good
Δ: unacceptable

TABLE 27

| name of layer | gas & its flow rate (sccm) | | RF power (W) | inner pressure (Torr) | substrate temperature (°C.) | layer thickness (μm) |
|---|---|---|---|---|---|---|
| charge injection inhibition layer | $SiH_4$ | 200 | 300 | 0.4 | 300 | 2 |
| | $CH_4$ | 50 | | | | |
| | $H_2$ | 500 | | | | |
| | NO | 10 | | | | |
| | $SiF_4$ | 80 ppm (against $SiH_4$) | | | | |
| | $B_2H_6$ | 2000 ppm (against $SiH_4$) | | | | |
| first photoconductive layer | $SiH_4$ | 500 | 1000 | 0.4 | 300 | 20 |
| | $H_2$ | 1000 | | | | |
| | $CH_4$ | 100 | | | | |
| | $SiF_4$ | 80 ppm (against $SiH_4$) | | | | |
| | $B_2H_6$ | 10→1 ppm (against $SiH_4$) (being decreased at a constant rate) | | | | |
| | $CO_2$ | 1000 ppm (against $SiH_4$) | | | | |
| second photoconductive layer | $SiH_4$ | 500 | 500 | 0.4 | 300 | 3 |
| | $H_2$ | 500 | | | | |
| | $SiF_4$ | 80 ppm (against $SiH_4$) | | | | |
| | $B_2H_6$ | 1 ppm (against $SiH_4$) | | | | |
| surface layer | $SiH_4$ | 50 | 500 | 0.3 | 300 | 0.5 |
| | $CH_4$ | 600 | | | | |
| | $SiF_4$ | 10 | | | | |

TABLE 28

| name of layer | gas & its flow rate (sccm) | | RF power (W) | inner pressure (Torr) | substrate temperature (°C.) | layer thickness (μm) |
|---|---|---|---|---|---|---|
| charge injection inhibition layer | $SiH_4$ | 300 | 700 | 0.5 | 300 | 5 |
| | $C_2H_2$ | 50 | | | | |
| | $H_2$ | 1000 | | | | |
| | $SiF_4$ | 50 ppm (against $SiH_4$) | | | | |
| | $B_2H_6$ | 3000 ppm (against $SiH_4$) | | | | |
| first photoconductive layer | $SiH_4$ | 300 | 700 | 0.5 | 300 | 25 |
| | $H_2$ | 1500 | | | | |
| | $C_2H_2$ | 50 | | | | |
| | $SiF_4$ | 50 ppm (against $SiH_4$) | | | | |
| | $B_2H_6$ | 6 ppm (against $SiH_4$) | | | | |
| | $CO_2$ | 1500 ppm | | | | |

TABLE 28-continued

| name of layer | gas & its flow rate (sccm) | RF power (W) | inner pressure (Torr) | substrate temperature (°C.) | layer thickness (μm) |
|---|---|---|---|---|---|
| | (against $SiH_4$) | | | | |
| second photoconductive layer | $SiH_4$ 300<br>$H_2$ 300<br>$B_2H_6$ 2 ppm (against $SiH_4$) | 300 | 0.4 | 300 | 5 |
| surface layer | $SiH_4$ 50<br>$CH_4$ 500<br>$CF_4$ 15 | 200 | 0.4 | 300 | 0.5 |

TABLE 29

| name of layer | gas & its flow rate (sccm) | RF power (W) | inner pressure (Torr) | substrate temperature (°C.) | layer thickness (μm) |
|---|---|---|---|---|---|
| charge injection inhibition layer | $SiH_4$ 200<br>$CH_4$ 50<br>$H_2$ 500<br>$SiF_4$ 70 ppm (against $SiH_4$)<br>$PH_3$ 1000 ppm (against $SiH_4$) | 300 | 0.4 | 250 | 3 |
| first photoconductive layer | $SiH_4$ 300<br>$H_2$ 1000<br>$CH_4$ 50<br>$SiF_4$ 50 ppm (against $SiH_4$)<br>$B_2H_6$ 0.8 ppm (against $SiH_4$) | 500 | 0.4 | 250 | 20 |
| second photoconductive layer | $SiH_4$ 300<br>$H_2$ 300<br>$SiF_4$ 30 ppm (against $SiH_4$) | 300 | 0.4 | 250 | 2 |
| surface layer | $SiH_4$ 50<br>$CH_4$ 300<br>$SiF_4$ 80 | 200 | 0.3 | 250 | 0.5 |

TABLE 30

| name of layer | gas & its flow rate (sccm) | μW power (W) | bias voltage (V) | inner pressure (mTorr) | substrate temperature (°C.) | layer thickness (μm) |
|---|---|---|---|---|---|---|
| first photoconductive layer | $SiH_4$ 300<br>$CH_4$ 100<br>$H_2$ 1500<br>He 1000<br>$SiF_4$ 70 ppm (against $SiH_4$)<br>$B_2H_6$ 5 ppm (against $SiH_4$)<br>$CO_2$ 1000 ppm (against $SiH_4$) | 1200 | 50 | 10 | 300 | 25 |
| second photoconductive layer | $SiH_4$ 300<br>He 2000<br>$SiF_4$ 50 ppm (against $SiH_4$)<br>$B_2H_6$ 3 ppm (against $SiH_4$) | 1200 | 50 | 7 | 300 | 5 |
| surface layer | $SiH_4$ 70<br>$CH_4$ 500<br>$SiF_4$ 50 | 1000 | 70 | 50 | 300 | 0.5 |

TABLE 31

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 500<br>$CH_4$ 100<br>$H_2$ 1000<br>He 1000<br>$SiF_4$ 50 ppm (against $SiH_4$)<br>$B_2H_6$ 500 ppm (against $SiH_4$) | 1000 | 60 | 10 | 350 | 3 |
| first photoconductive layer | $SiH_4$ 300<br>$CH_4$ 30<br>$H_2$ 1500<br>He 2000<br>$SiF_4$ 50 ppm (against $SiH_4$)<br>$B_2H_6$ 5 ppm (against $SiH_4$)<br>$CO_2$ 1200 ppm (against $SiH_4$) | 1000 | 50 | 10 | 350 | 25 |
| second photoconductive layer | $SiH_4$ 300<br>$H_2$ 500<br>$SiF_4$ 50 ppm (against $SiH_4$) | 1000 | 50 | 10 | 350 | 5 |
| surface layer | $SiH_4$ 100<br>$CH_4$ 500<br>$SiF_4$ 30 | 1000 | 80 | 7 | 350 | 0.5 |

TABLE 32

| name of layer | gas & its flow rate (sccm) | μW power (W) | bias voltage (V) | inner pressure (mTorr) | substrate temperature (°C.) | layer thickness (μm) |
|---|---|---|---|---|---|---|
| charge injection inhibition layer | $SiH_4$ 400<br>$CH_4$ 100<br>$H_2$ 1500<br>He<br>$SiF_4$ 80 ppm (against $SiH_4$)<br>$B_2H_6$ 1000 ppm (against $SiH_4$) | 1000 | 50 | 10 | 350 | 3 |
| first photoconductive layer | $SiH_4$ 300<br>$CH_4$ 50<br>$H_2$ 2000<br>He 1000<br>$SiF_4$ 80 ppm (against $SiH_4$)<br>$B_2H_6$ 10 ppm (against $SiH_4$)<br>$CO_2$ 1000 ppm (against $SiH_4$) | 1000 | 50 | 7 | 350 | 25 |
| second photoconductive layer | $SiH_4$ 300<br>$SiF_4$ 80 ppm (against $SiH_4$)<br>$B_2H_6$ 1 ppm (against $SiH_4$) | 1000 | 50 | 10 | 350 | 3 |
| surface layer | $SiH_4$ 50<br>$CH_4$ 300<br>$SiF_4$ 50 | 1000 | 100 | 5 | 350 | 0.5 |

TABLE 33

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 400 | 1000 | 50 | 10 | 350 | 3 |
| | $CH_4$ | 100 | | | | | |
| | $H_2$ | 1500 | | | | | |
| | He | | | | | | |
| | $SiF_4$ | 80 ppm (against $SiH_4$) | | | | | |
| | $B_2H_6$ | 1000 ppm (against $SiH_4$) | | | | | |
| first photoconductive layer | $SiH_4$ | 300 | 1000 | 50 | 7 | 350 | 25 |
| | $CH_4$ | 50 | | | | | |
| | $H_2$ | 2000 | | | | | |
| | He | 1000 | | | | | |
| | $SiF_4$ | 80 ppm (against $SiH_4$) | | | | | |
| | $B_2H_6$ | 10 ppm (against $SiH_4$) | | | | | |
| | $CO_2$ | 800 ppm (against $SiH_4$) | | | | | |
| second photoconductive layer | $SiH_4$ | 300 | 1000 | 50 | 10 | 350 | 3 |
| | He | 2000 | | | | | |
| | $B_2H_6$ | 1 ppm (against $SiH_4$) | | | | | |
| surface layer | $SiH_4$ | 50 | 1000 | 100 | 5 | 350 | 0.5 |
| | $CH_4$ | 300 | | | | | |
| | $SiF_4$ | 50 | | | | | |
| | He | 2000 | | | | | |

TABLE 34

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 400 | 1000 | 50 | 10 | 350 | 3 |
| | $CH_4$ | 100 | | | | | |
| | $H_2$ | 1500 | | | | | |
| | He | | | | | | |
| | $SiF_4$ | 80 ppm (against $SiH_4$) | | | | | |
| | $B_2H_6$ | 1000 ppm (against $SiH_4$) | | | | | |
| | $CO_2$ | 900 ppm (against $SiH_4$) | | | | | |
| first photoconductive layer | $SiH_4$ | 300 | 1000 | 50 | 7 | 350 | 25 |
| | $CH_4$ | 50 | | | | | |
| | $H_2$ | 2000 | | | | | |
| | He | 1000 | | | | | |
| | $SiF_4$ | 80 ppm (against $SiH_4$) | | | | | |
| | $B_2H_6$ | 10 ppm (against $SiH_4$) | | | | | |
| | $CO_2$ | 800 ppm (against $SiH_4$) | | | | | |
| second photoconductive layer | $SiH_4$ | 300 | 1000 | 50 | 10 | 350 | 3 |
| | He | 2000 | | | | | |
| | $SiF_4$ | 10 ppm (against $SiH_4$) | | | | | |
| | $B_2H_4$ | 2 ppm (against $SiH_4$) | | | | | |
| | $CO_2$ | 100 ppm (against $SiH_4$) | | | | | |
| surface layer | $SiH_4$ | 50 | 1000 | 100 | 5 | 350 | 0.5 |
| | $CH_4$ | 300 | | | | | |
| | $SiF_4$ | 50 | | | | | |
| | He | 2000 | | | | | |
| | $CO_2$ | 500 ppm (against $SiH_4$) | | | | | |

TABLE 35

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 400 | 1000 | 50 | 10 | 350 | 3 |
| | $CH_4$ | 100 | | | | | |
| | $H_2$ | 1500 | | | | | |
| | He | | | | | | |
| | $SiF_4$ | 80 ppm (against $SiH_4$) | | | | | |
| | $B_2H_6$ | 1000 ppm (against $SiH_4$) | | | | | |
| | NO | 500 ppm (against $SiH_4$) | | | | | |
| first photoconductive layer | $SiH_4$ | 300 | 1000 | 50 | 7 | 350 | 25 |
| | $CH_4$ | 50 | | | | | |
| | $H_2$ | 2000 | | | | | |
| | He | 1000 | | | | | |
| | $SiF_4$ | 80 ppm (against $SiH_4$) | | | | | |
| | $B_2H_6$ | 10 ppm (against $SiH_4$) | | | | | |
| | $CO_2$ | 800 ppm (against $SiH_4$) | | | | | |
| | NO | 500 ppm (against $SiH_4$) | | | | | |
| second photoconductive layer | $SiH_4$ | 300 | 1000 | 50 | 10 | 350 | 5 |
| | He | 2000 | | | | | |
| | $SiF_4$ | 10 ppm (against $SiH_4$) | | | | | |
| | $B_2H_4$ | 2 ppm (against $SiH_4$) | | | | | |
| | NO | 100 ppm (against $SiH_4$) | | | | | |
| surface layer | $SiH_4$ | 50 | 1000 | 100 | 5 | 350 | 0.5 |
| | $CH_4$ | 300 | | | | | |
| | $SiF_4$ | 50 | | | | | |
| | He | 2000 | | | | | |
| | NO | 500 ppm (against $SiH_4$) | | | | | |

TABLE 36

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| charge injection inhibition layer | $SiH_4$ | 400 | 1000 | 50 | 10 | 350 | 2.5 |
| | $CH_4$ | 100 | | | | | |
| | $H_2$ | 1500 | | | | | |
| | He | | | | | | |
| | $SiF_4$ | 80 ppm (against $SiH_4$) | | | | | |
| | $B_2H_6$ | 1000 ppm (against $SiH_4$) | | | | | |
| | NO | 500 ppm (against $SiH_4$) | | | | | |
| transition layer region | $SiH_4$ | 400→300 | 1000 | 50 | 10→7 | 350 | 3 |
| | $CH_4$ | 100→50 | | | | | |
| | $H_2$ | 2000 | | | | | |
| | He | 1000 | | | | | |
| | $SiF_4$ | 80 ppm (against $SiH_4$) | | | | | |
| | $B_2H_6$ | 1000→10 ppm (against $SiH_4$) | | | | | |
| | $CO_2$ | 0→800 ppm (against $SiH_4$) | | | | | |
| | NO | 500 ppm (against $SiH_4$) | | | | | |
| first photoconductive layer | $SiH_4$ | 300 | 1000 | 50 | 7 | 350 | 21 |
| | $CH_4$ | 50 | | | | | |
| | $H_2$ | 2000 | | | | | |
| | He | 1000 | | | | | |
| | $SiF_4$/He | 80 ppm (against $SiH_4$) | | | | | |
| | $B_2H_6$ | 10 ppm | | | | | |

TABLE 36-continued

| name of layer | gas & its flow rate (sccm) | | μW power (W) | bias voltage (V) | inner pressure (mTorr) | substrate temperature (°C.) | layer thickness (μm) |
|---|---|---|---|---|---|---|---|
| | | (against $SiH_4$) | | | | | |
| | $CO_2$ | 800 ppm (against $SiH_4$) | | | | | |
| | NO | 500 ppm (against $SiH_4$) | | | | | |
| transition layer region | $SiH_4$ | 300 | 1000 | 50 | 7→10 | 350 | 3 |
| | $CH_4$ | 50→0 | | | | | |
| | $H_2$ | 2000→0 | | | | | |
| | He | 1000→2000 | | | | | |
| | $SiF_4$ | 80→10 ppm (against $SiH_4$) | | | | | |
| | $B_2H_6$ | 10→2 ppm (against $SiH_4$) | | | | | |
| | $CO_2$ | 800→0 ppm (against $SiH_4$) | | | | | |
| | NO | 500→100 ppm (against $SiH_4$) | | | | | |
| second photoconductive layer | $SiH_4$ | 300 | 1000 | 50 | 10 | 350 | 6 |
| | He | 2000 | | | | | |
| | $SiF_4$/He | 10 ppm (against $SiH_4$) | | | | | |
| | $B_2H_6$ | 2 ppm (against $SiH_4$) | | | | | |
| | NO | 100 ppm (against $SiH_4$) | | | | | |
| transition layer region | $SiH_4$ | 300→50 | 1000 | 50→100 | 10 | 350 | 0.1 |
| | $CH_4$ | 0→300 | | | | | |
| | He | 2000 | | | | | |
| | $SiF_4$/He | 50→0 ppm (against $SiH_4$) | | | | | |
| | $SiF_4$ | 0→50 ppm | | | | | |
| | $B_2H_6$ | 2→0 ppm (against $SiH_4$) | | | | | |
| | NO | 100→500 ppm (against $SiH_4$) | | | | | |
| surface layer | $SiH_4$ | 50 | 1000 | 100 | 5 | 350 | 0.5 |
| | $CH_4$ | 300 | | | | | |
| | $SiF_4$ | 50 | | | | | |
| | He | 2000 | | | | | |
| | NO | 500 ppm (against $SiH_4$) | | | | | |

What is claimed is:

1. A light receiving member having a light receiving layer comprising a photoconductive layer and a surface layer disposed on a conductive substrate, wherein said photoconductive layer comprises, from the side of said substrate, a first photoconductive layer constituted by an amorphous material containing silicon atoms as a matrix, carbon atoms, hydrogen atoms and fluorine atoms and a second photoconductive layer constituted by an amorphous material containing silicon atoms as a matrix, and at least one kind of atoms selected from hydrogen atoms and fluorine atoms, the content of said fluorine atoms in said first photoconductive layer being in the range of from 1 to 95 atomic ppm based on the content of said silicon, and wherein said surface layer comprises a layer containing silicon atoms as a matrix, at least one kind of atoms selected from the group consisting of carbon atoms, nitrogen atoms and oxygen atoms, and at least one kind of atoms selected from the group consisting of hydrogen atoms and fluorine atoms.

2. A light receiving member as defined in claim 1, wherein the photoconductive layer contains an element belonging to the group III or the group V of the periodic table in at least a portion thereof.

3. A light receiving member as defined in claim 2, wherein the photoconductive layer has a portion containing the element belonging to the group III or group V in a state of being distributed unevenly in the thickness direction.

4. A light receiving member as defined in claim 1, wherein the surface layer comprises a layer containing silicon atoms as a matrix, nitrogen atoms, oxygen atoms and at least one kind of atoms selected from hydrogen atoms and halogen atoms.

5. A light receiving member as defined in claim 1, wherein the surface layer comprises a layer containing silicon atoms as a matrix, carbon atoms, nitrogen atoms, oxygen atoms and at least one kind of atoms selected from hydrogen atoms and halogen atoms.

6. A light receiving member as defined in claim 1, wherein the surface layer comprises a layer containing silicon atoms as a matrix, carbon atoms, hydrogen atoms and fluorine atoms.

7. A light receiving member as defined in claim. 1, wherein both of the first and the second photoconductive layers contain an element belonging to the group III of the periodic table.

8. A light receiving member as defined in claim 1, wherein a charge injection inhibition layer constituted by an amorphous material containing silicon atoms as a matrix, at least one of kind of atoms selected from the group consisting of carbon atoms, nitrogen atoms and oxygen atoms, at least one kind of atoms selected from hydrogen atoms and halogen atoms, and an element belonging to the group III or the group V of the periodic table is disposed between the conductive substrate and the first photoconductive layer.

9. A light receiving member as defined in claim 8, wherein the charge injection inhibition layer comprises a layer containing silicon atoms as a matrix, carbon atoms, an element belonging to the group III of the periodic table and hydrogen atoms.

10. A light receiving member as defined in claim 8, wherein the charge injection inhibition layer comprises a layer containing silicon atoms as a matrix, carbon atoms, nitrogen atoms, oxygen atoms and fluorine atoms.

11. A light receiving member as defined in claim 10, wherein the layer to be the charge injection inhibition layer further contains an element belonging to the group III of the periodic table.

12. A light receiving member as defined in claim 10, wherein the layer to be the charge injection inhibition layer further contains an element belonging to the group V of the periodic table.

13. A light receiving member as defined in claim 1, wherein the content of the fluorine atoms in the first photoconductive layer is in the range of from 5 to 80 atomic ppm based on the content of the silicon atoms.

14. A light receiving member as defined in claim 1, wherein the content of the fluorine atoms in the first photoconductive layer is in the range of from 10 to 70 atomic ppm based on the content of the silicon atoms.

15. A light receiving member as defined in claim 1, wherein the first photoconductive layer comprises a film formed by a microwave glow discharging process.

16. A light receiving member as defined in claim 1, wherein the first photoconductive layer comprises a film formed by a RF glow discharging process.

17. A light receiving member having a light receiving layer comprising a photoconductive layer and a surface layer disposed on a conductive substrate, wherein said photoconductive layer comprises, from the side of said substrate, a first photoconductive layer constituted by an amorphous material containing silicon atoms as a matrix, carbon atoms, hydrogen atoms, fluorine atoms and oxygen atoms and a second photoconductive layer constituted by an amorphous material containing silicon atoms as a matrix, and at least one kind of atoms selected from hydrogen atoms and fluorine atoms, the content of said fluorine atoms in said first photoconductive layer being in the range of from 1 to 95 atomic ppm based on the content of said silicon atoms, and the content of said oxygen atoms in said first photoconductive layer being in the range of from 600 to 10,000 ppm based on the content of said silicon atoms, and wherein said surface layer comprises a layer containing silicon atoms as a matrix, at least one kind of atoms selected from the group consisting of carbon atoms, nitrogen atoms and oxygen atoms, and at least one kind of atoms selected from the group consisting of hydrogen atoms and fluorine atoms.

18. A light receiving member as defined in claim 17, wherein the photoconductive layer contains an element belonging to the group III or the group V of the periodic table in at least a portion thereof.

19. A light receiving member as defined in claim 18, wherein the photoconductive layer has a portion containing the element belonging to the group III or group V in a state of being distributed unevenly in the thickness direction.

20. A light receiving member as defined in claim 17, wherein the surface layer comprises a layer containing silicon atoms as a matrix, at least one kind of atoms selected from the group consisting of carbon atoms, nitrogen atoms and oxygen atoms, hydrogen atoms and halogen atoms, in which the content of said halogen atoms is less than 20 atomic %, and the sum of the contents for said hydrogen atoms and said halogen atom is from 30 to 70 atomic %.

21. A light receiving member as defined in claim 17, wherein a charge injection inhibition layer constituted by an amorphous material containing silicon atoms as a matrix, at least one kind of atoms selected from the group consisting of carbon atoms, nitrogen atoms and oxygen atoms, at least one kind of atoms selected from hydrogen atoms and halogen atoms, and an element belonging to the group III or the group V of the periodic table is disposed between the conductive substrate and the first photoconductive layer.

22. A light receiving member as defined in claim 17, wherein the content of the fluorine atoms in the first photoconductive layer is from 5 to 80 atomic ppm based on the content of the silicon atoms.

23. A light receiving member as defined in claim 17, wherein the content of the fluorine atoms in the first photoconductive layer is from 10 to 70 atomic ppm based on the content of the silicon atoms.

24. A light receiving member as defined in claim 17, wherein the first photoconductive layer comprises a film formed by a microwave glow discharging process.

25. A light receiving member as defined in claim 17, wherein the first photoconductive layer comprises a film formed by a RF glow discharging process.

26. A light receiving member as defined in claim 17, wherein the content of the oxygen atoms in the first photoconductive layer is from 600 to 5000 atomic ppm based on the content of the silicon atoms.

27. A light receiving member comprising:

a conductive substrate, a charge injection inhibition layer disposed on said conductive substrate, said charge injection inhibition layer containing silicon atoms as a matrix, and conductivity controlling element, a first photoconductive layer disposed on said charge injection inhibition layer, said first photoconductive layer being constituted by an amorphous material containing silicon atoms as a matrix, carbon atoms, hydrogen atoms, fluorine atoms and oxygen atoms, wherein the content of said fluorine atoms is from 1 to 95 atomic ppm based on the content of said silicon atoms, and the content of said oxygen atoms is from 600 to 10,000 atomic ppm based on the content of said silicon atoms, a second photoconductive layer disposed on said first photoconductive layer, said second photoconductive layer being constituted by an amorphous material containing silicon atoms as a matrix, and at least one kind of atoms selected from hydrogen atoms and fluorine atoms, and a surface layer disposed on said second photoconductive layer, said surface layer being constituted by an amorphous material containing silicon atoms as a matrix, at least one kind of atoms selected from the group consisting of carbon atoms, nitrogen atoms and oxygen atoms, hydrogen atoms and halogen atoms, wherein the content of said halogen atoms is less than 20 atomic %, and the sum for the contents of said hydrogen atoms and said halogen atoms is from 30 to 70 atomic %.

28. A light receiving member as defined in claim 27, wherein the content of the fluorine atoms in the first photoconductive layer is from 5 to 80 atomic ppm based on the content of the silicon atoms.

29. A light receiving member as defined in claim 27, wherein the content of the fluorine atoms in the first photoconductive layer is from 10 to 70 atomic ppm based on the content of the silicon atoms.

30. A light receiving member as defined in claim 27, wherein the first photoconductive layer comprises a film formed by a microwave glow discharging process.

31. A light receiving member as defined in claim 27, wherein the first photoconductive layer comprises a film formed by a RF glow discharging process.

32. A light receiving member as defined in claim 27, wherein the content of the oxygen atoms in the first photoconductive layer is from 600 to 5000 atomic ppm based on the content of the silicon atoms.

* * * * *

UNITED STATES PATENT AND TRADEMARK OFFICE

CERTIFICATE OF CORRECTION

PATENT NO. : 5,656,404

DATED : August 12, 1997

INVENTOR(S) : HIROAKI NIINO ET AL.

It is certified that error appears in the above-indentified patent and that said Letters Patent is hereby corrected as shown below:

SHEET 6

FIG. 6, "OXGEN" should read --OXYGEN--.

SHEET 7

FIG. 7, "OXGEN" should read --OXYGEN--.

SHEET 8

FIG. 8, "OXGEN" should read --OXYGEN--.

SHEET 9

FIG. 9, "OXGEN" should read --OXYGEN--.

COLUMN 5

Line 10, "the high withstanding" should read --resistance to high--.
Line 16, "minutes" should read --minute--.

COLUMN 7

Line 60, "above stated," should read --is stated above,--

UNITED STATES PATENT AND TRADEMARK OFFICE

CERTIFICATE OF CORRECTION

PATENT NO. : 5,656,404

DATED : August 12, 1997

INVENTOR(S) : HIROAKI NIINO ET AL.

It is certified that error appears in the above-indentified patent and that said Letters Patent is hereby corrected as shown below:

COLUMN 19

Line 40, "An" should read --A--.

COLUMN 22

Line 38, "content" should read --contents--.

COLUMN 24

Line 40, "no-SiC" should read --non-SiC--.

COLUMN 25

Line 18, "Protrusion" should read --Protrusions--.

COLUMN 27

Line 16, "dusts of" should read --dust from-- and "are" should read --is--.
Line 61, "does" should read --dose--.

COLUMN 29

Line 60, "plow" should read --glow--.

COLUMN 30

Line 54, "non-SIC" should read --non-SiC-- and "layers" should read --layer--.

UNITED STATES PATENT AND TRADEMARK OFFICE

CERTIFICATE OF CORRECTION

PATENT NO. : 5,656,404

DATED : August 12, 1997

INVENTOR(S) : HIROAKI NIINO ET AL.

It is certified that error appears in the above-indentified patent and that said Letters Patent is hereby corrected as shown below:

COLUMN 31

Line 26, "withstand," should read --resistance,--.

COLUMN 32

Line 3, "withstand" should read --resistance--.
Table 1(A), "$SiF_4/H_3$" should read --$SiF_4/H_2$--.

COLUMN 37

Table 9(A), "Photo-" should read --photo---.

COLUMN 41

Table 13, "$H_4$" should read --$H_2$--.

COLUMN 49

Table 23(C), "sperical" should read --spherical--.

COLUMN 51

Table 24(C), "sperical" should read --spherical--.

COLUMN 55

Table 26(C), "sperical" should read --spherical--.

UNITED STATES PATENT AND TRADEMARK OFFICE

CERTIFICATE OF CORRECTION

PATENT NO. : 5,656,404

DATED : August 12, 1997

INVENTOR(S) : HIROAKI NIINO ET AL.

It is certified that error appears in the above-indentified patent and that said Letters Patent is hereby corrected as shown below:

COLUMN 68

Line 12, "atom" should read --atoms--.

Signed and Sealed this

FourthDay of August, 1998

Bruce Lehman

*Attest:*

BRUCE LEHMAN

*Attesting Officer*

*Commissioner of Patents and Trademarks*